US005900122A

United States Patent [19]

Huston

[11] Patent Number: 5,900,122

[45] Date of Patent: May 4, 1999

[54] CELLULOSIC WEB, METHOD AND APPARATUS FOR MAKING THE SAME USING PAPERMAKING BELT HAVING ANGLED CROSS-SECTIONAL STRUCTURE, AND METHOD OF MAKING THE BELT

[75] Inventor: Larry L. Huston, West Chester, Ohio

[73] Assignee: The Procter & Gamble Company, Cincinnati, Ohio

[21] Appl. No.: 08/858,661

[22] Filed: May 19, 1997

[51] Int. Cl.[6] ..... D21F 1/10

[52] U.S. Cl. ..... 162/348; 162/116; 162/117; 162/903

[58] Field of Search ..... 162/900, 348, 162/901, 903, 902, 358.2, 358.3; 428/137

[56] References Cited

U.S. PATENT DOCUMENTS

| | | | |
|---|---|---|---|
| 4,514,345 | 4/1985 | Johnson et al. | 264/22 |
| 4,528,239 | 7/1985 | Trokhan | 428/247 |
| 4,529,480 | 7/1985 | Trokhan | 162/109 |
| 4,637,859 | 1/1987 | Trokhan | 162/109 |
| 5,245,025 | 9/1993 | Trokhan et al. | 536/56 |
| 5,334,289 | 8/1994 | Trokhan et al. | 162/358.2 |
| 5,514,523 | 5/1996 | Trokhan et al. | 430/320 |
| 5,527,428 | 6/1996 | Trokhan et al. | 162/116 |

FOREIGN PATENT DOCUMENTS

| | | |
|---|---|---|
| WO 92/00416 | 1/1992 | WIPO . |
| WO 93/00474 | 1/1993 | WIPO . |
| WO 93/00475 | 1/1993 | WIPO . |
| WO 98/01618 | 1/1998 | WIPO . |

*Primary Examiner*—Brenda A. Lamb
*Attorney, Agent, or Firm*—Vladimir Vitenberg; Larry L. Huston; E. Kelly Linman

[57] ABSTRACT

A papermaking forming belt and a method of making the same, as well a cellulosic web and the process of making the web are disclosed. The belt comprises an air-permeable reinforcing structure and a resinous framework. The reinforcing structure has a web-facing side defining an X-Y plane, a machine-facing side opposite the web-facing side, and a Z-direction perpendicular to the X-Y plane. The resinous framework is comprised of a plurality of discrete protuberances extending from the reinforcing structure, each of the protuberances having an axis, a top surface, a base surface opposite the top surface, and walls. The axes of at least some of the protuberances and the Z-direction form an acute angles therebetween. The web produced on the belt has at least two regions disposed in a non-random and repeating pattern: a macroscopically planar and patterned first region comprising an essentially continuous network and preferably having a relatively high basis weight, and a second region comprised of a plurality of discrete knuckles circumscribed by and adjacent to said first region and preferably having a relatively low basis weight. The knuckles extend from the first region in at least one direction, that at least one direction and said Z-axis forming an acute angle therebetween.

11 Claims, 9 Drawing Sheets

CELLULOSIC WEB, METHOD AND APPARATUS FOR MAKING THE SAME USING PAPERMAKING BELT HAVING ANGLED CROSS-SECTIONAL STRUCTURE, AND METHOD OF MAKING THE BELT

FIELD OF THE INVENTION

The present invention is related to processes for making strong, soft, absorbent cellulosic webs. More particularly, this invention is concerned with structured cellulosic webs having low density regions and high density regions, and with papermaking belts utilized for making such paper webs.

BACKGROUND OF THE INVENTION

Paper products are used for a variety of purposes. Paper towels, facial tissues, toilet tissues, and the like are in constant use in modern industrialized societies. The large demand for such paper products has created a demand for improved versions of the products. If the paper products such as paper towels, facial tissues, toilet tissues, and the like are to perform their intended tasks and to find wide acceptance, they must possess certain physical characteristics. Among the more important of these characteristics are strength, softness, and absorbency.

Strength is the ability of a paper web to retain its physical integrity during use.

Softness is the pleasing tactile sensation consumers perceive when they use the paper for its intended purposes.

Absorbency is the characteristic of the paper that allows the paper to take up and retain fluids, particularly water and aqueous solutions and suspensions. Important not only is the absolute quantity of fluid a given amount of paper will hold, but also the rate at which the paper will absorb the fluid.

Through-air drying papermaking belts comprising a reinforcing structure and a resinous framework are described in commonly assigned U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,334,289 issued to Trokhan et al on Aug. 2, 1994. The foregoing patents are incorporated herein by reference for the purpose of showing preferred constructions of through-air drying papermaking belts.

The paper produced on the belts disclosed in these patents is characterized by having two physically distinct regions: a continuous network region having a relatively high density and a region comprised of a plurality of domes dispersed throughout the whole of the network region. The domes are of relatively low density and relatively low intrinsic strength compared to the network regions. Such belts have been used to produce commercially successful products such as Bounty paper towels and Charmin Ultra toilet tissue, both produced and sold by the instant assignee.

U.S. Pat. No. 5,245,025 issued to Trokhan et al. on Sep. 14, 1993; and U.S. Pat. No. 5,527,428 issued to Trokhan et al. on Jun. 18, 1996, which are incorporated herein by reference, disclose a cellulosic fibrous structure comprising a plurality of regions: an essentially continuous first region of a relatively high basis weight; a second region of a relatively low or zero basis weight and circumscribed by and adjacent the first region; and a third region of an intermediate basis weight and juxtaposed with the second region. A forming belt for producing such a paper comprises a patterned array of discrete protuberances joined to a reinforcing structure. Annuluses between adjacent protuberances provide space into which papermaking fibers may be deflected to form the first region. In addition, each individual protuberance may have an aperture therein. The apertures in the individual protuberances also provide space into which the papermaking fibers may deflect to form the third region.

Still, a search for improved products has continued.

It may be desirable in some instances to produce cellulosic webs having "angled" cross-sectional patterns, i.e., the webs which—when viewed in the cross-section—have the domes extending from an essentially continuous network region such that the domes are not generally perpendicular, but instead are acutely angled, relative to the plane of the network region. Particularly, such "angled" domes may improve the web's softness due to increased collapsibility of the angles domes, compared to the perpendicularly upstanding domes. In addition, it is believed that such angled structures will possess an ability to direct absorbed fluids in a desired (and predetermined) direction, based on the specific (and also predetermined) orientation of the domes in the web. Such properties may be very beneficial in a variety of disposable products.

Therefore, it is an object of the present invention to provide a cellulosic web having at least two regions: an essentially continuous region and a region comprising a patterned array of discrete domes or knuckles extending from the essentially continuous region such that the axes of the domes or knuckles and the general plane of the essentially continuous region form acute angles therebetween.

It is another object of the present invention to provide a process of making such cellulosic webs.

It is still another object of the present invention to provide a papermaking belt for producing such cellulosic webs.

It is further object of the present invention to provide a process of making such papermaking belt.

SUMMARY OF THE INVENTION

A macroscopically monoplanar papermaking belt of the present invention may be used in a papermaking machine as a forming belt and/or as a through-air drying belt.

The through-air drying belt comprises a resinous framework having a web-side surface which defines an X-Y plane, a backside surface opposite the web-side surface, a Z-direction perpendicular to the X-Y plane, and a plurality of discrete deflection conduits extending between the web-side surface and the backside surface. Preferably, the plurality of conduits comprises a non-random repeating patterned array. Each of the discrete conduits has an axis and walls. The axes of at least some of the discrete conduits and the Z-direction form acute angles therebetween. Preferably, the through-air drying belt further comprises an air-permeable reinforcing structure positioned between the web-side surface and the backside surface of the resinous framework. The reinforcing structure has a web-facing side and a machine-facing side opposite the web-facing side.

In the through-air drying belt, the web-side surface of the framework has an essentially continuous web-side network formed therein, and the backside surface of the framework has a backside network formed therein. The web-side network defines web-side openings, and the backside network defines backside openings of the discrete conduits. The web-side openings are off-set relative to the corresponding backside openings within the X-Y plane in at least one direction perpendicular to the Z-direction. The discrete conduits may be tapered, preferably negatively tapered, relative to their respective axes in at least one direction perpendicular to the Z-direction.

The forming belt of the present invention comprises an air-permeable reinforcing structure and a resinous framework joined to the reinforcing structure. The reinforcing structure has a web-facing side defining an X-Y plane, a machine-facing side opposite the web-facing side, and a Z-direction perpendicular to the X-Y plane. The resinous framework is comprised of a plurality of discrete protuberances joined to and extending from the reinforcing structure. Each of the protuberances has an axis, a top surface, a base surface opposite the top surface, and walls spacing apart and interconnecting the top surface and the base surface. Preferably, the discrete protuberances are circumscribed by and adjacent to an area of essentially continuous deflection conduits. A plurality of the top surfaces defines a web-side surface, and a plurality of the base surfaces defines a backside surface of the resinous framework.

In the forming belt of the present invention, the axes of at least some of the protuberances and the Z-direction form an acute angles therebetween. The top surfaces of at least some of the protuberances are off-set relative to the corresponding base surfaces of the same protuberances within the X-Y plane in at least one direction perpendicular to the Z-direction. The web-facing side of the reinforcing structure has preferably an essentially continuous web-facing network formed therein, which web-facing network is defined by the area of essentially continuous deflection conduits. The walls of at least some of the protuberances may be tapered relative the axes of these protuberances. Preferably, the plurality of protuberances comprises a non-random repeating patterned array in the X-Y plane. In one embodiment, the plurality of discrete protuberances has a plurality of discrete deflection conduits extending from the web-side surface to the back surface of the resinous framework. Preferably, each of the plurality of discrete protuberances has at least one discrete deflection conduit therein. In both the through-air drying belt and the forming belt, the backside surface may optionally be textured.

A method of making the belt of the present invention comprises the steps of:

(a) providing an apparatus for generating curing radiation in a first direction;

(b) providing a liquid photosensitive resin;

(c) providing a forming unit having a working surface and capable of receiving the liquid photosensitive resin; ( d) providing an air-permeable reinforcing structure to be joined to the cured photosensitive resin, the reinforcing structure having a web-facing side and a machine-facing side opposite said web-facing side;

(e) disposing said reinforcing structure in said forming unit;

(f) disposing the liquid photosensitive resin in said forming unit thereby forming a coating of the liquid photosensitive resin, the coating having a first surface and a second surface opposite the first surface, and a pre-selected thickness defined by these first and second surfaces;

(g) disposing the forming unit containing the coating of liquid photosensitive resin in the first direction such that the first surface of the coating and the first direction form an acute angle therebetween;

(h) providing a mask having opaque regions and transparent regions defining a pre-selected pattern;

(i) positioning the mask between the first surface of the coating and the apparatus for generating curing radiation such that the mask is in adjacent relation with the first surface, the opaque regions of the mask shielding a portion of the coating from the curing radiation of the apparatus, and the transparent regions leaving other portions of the coating unshielded for the curing radiation of the apparatus;

(j) curing said unshielded portions of the coating, and leaving the shielded portions of the coating uncured by exposing the coating to radiation having an activating wavelength from the apparatus for generating curing radiation through the mask to form a partially-formed belt;

(k) removing substantially all uncured liquid photosensitive resin from the partially-formed belt to leave a hardened resinous structure which forms a framework having a web-side surface formed by the first surface being cured and a backside surface formed by the second surface being cured. Depending on a particular predetermined design of the desired framework (continuous framework for the through-air drying belt, or the framework comprising the plurality of protuberances for the forming belt), the belt will have either a plurality of discrete conduits in the regions which were shielded from the curing radiation by the opaque regions of the mask, or a plurality of discrete protuberances extending from the reinforcing structure in the regions which were not shielded and therefore became cured.

The steps (d) and (e) are the necessary steps for making the forming belt, and the highly preferred steps for making the through-air drying belt.

A cellulosic web made by using the through-air drying belt having an essentially continuous framework will have at least two regions disposed in a non-random and repeating pattern: a macroscopically monoplanar, patterned, and essentially continuous network region forming a network plane and preferably having relatively high density, and a domes region preferably having relatively low density. The domes region comprises discrete domes extending from the network plane in at least one direction such that this at least one direction and the network plane form an acute angle therebetween.

The cellulosic web formed on the forming belt having the framework comprised of the plurality of discrete protuberances will have at least two regions disposed in a non-random and repeating pattern: a macroscopically planar and patterned first region defining an X-Y plane and preferably having a relatively high basis weight, and a second region preferably having a relatively low basis weight and circumscribed by and adjacent to the first region. The first region comprises an essentially continuous network formed over the area of essentially continuous conduits of the forming belt's framework. The second region is comprised of a plurality of discrete knuckles formed over the discrete protuberances of the forming belt's framework. The protuberances extend from the first region in at least one "angled" direction such that this at least one direction and the X-Y plane form an acute angle therebetween. The web formed on the forming belt having the discrete deflection conduits through the protuberances may also have a third region having an intermediate basis weight relative to the basis weight of the first region and the basis weight of the second region, the third region being juxtaposed with the second region.

In its through-air drying aspect, a process for producing a cellulosic fibrous web comprises the steps of:

(a) providing a plurality of cellulosic papermaking fibers suspended in a liquid carrier;

(b) providing a forming belt;

(c) depositing the plurality of cellulosic papermaking fibers suspended in a liquid carrier on the forming belt;

(d) draining the liquid carrier through the forming belt thereby forming an embryonic web of the papermaking fibers on the forming belt;

(e) providing a macroscopically monoplanar through-air drying belt comprising a resinous framework having a web-side surface defining an X-Y plane, a backside surface opposite the web-side surface, a Z-direction perpendicular to the X-Y plane, and a plurality of discrete deflection conduits extending between the web-side surface and the backside surface, each of the conduits having an axis and walls, the axes of at least some of the conduits and the Z-direction forming an acute angles therebetween;

(f) depositing the embryonic web to the web-side surface of the resinous framework of the through-air drying belt;

(g) applying a fluid pressure differential to the embryonic web to deflect at least a portion of the papermaking fibers into the discrete deflection conduits and to remove water from the embryonic web into the discrete deflection conduits thereby forming an intermediate web which comprises a macroscopically monoplanar, patterned, and essentially continuous network region, and a domes region comprising a plurality of discrete domes protruding from, circumscribed by, and adjacent to the network region, each of the domes having an axis, the axes of at least some of the domes and the Z-direction forming acute angles therebetween.

A process for producing the embryonic cellulosic fibrous web on the forming belt of the present invention comprises the steps of:

(a) providing a plurality of cellulosic fibers suspended in a liquid carrier;

(b) providing a macroscopically monoplanar forming belt comprising an air-permeable reinforcing structure having a web-facing side defining an X-Y plane, a machine-facing side opposite said web-facing side, and a Z-direction perpendicular to said X-Y plane, the forming belt further comprising a resinous framework comprised of a plurality of discrete protuberances joined to and extending from the reinforcing structure, each of the protuberances having a base surface, a top surface, walls spacing apart and interconnecting the base surface and the top surface, and an axis, the axes of at least some of the protuberances and the Z-direction forming acute angles therebetween, a plurality of the top surfaces defining a web-side surface of the resinous framework, and a plurality of the base surfaces defining a backside surface of the resinous framework;

(c) depositing the cellulosic fibers and the carrier onto the forming belt;

(d) draining the liquid carrier through the forming belt, thereby forming a macroscopically planar and patterned first region disposed in the X-Y plane, the first region comprising an essentially continuous network and preferably having a relatively high basis weight; and a second region comprised of a plurality of discrete knuckles circumscribed by and adjacent to the first region and preferably having a relatively low basis weight, the knuckles extending from the first region in at least one direction, this at least one direction and the Z-direction forming an acute angle therebetween.

DETAILED DESCRIPTION OF THE INVENTION

Figure 6:
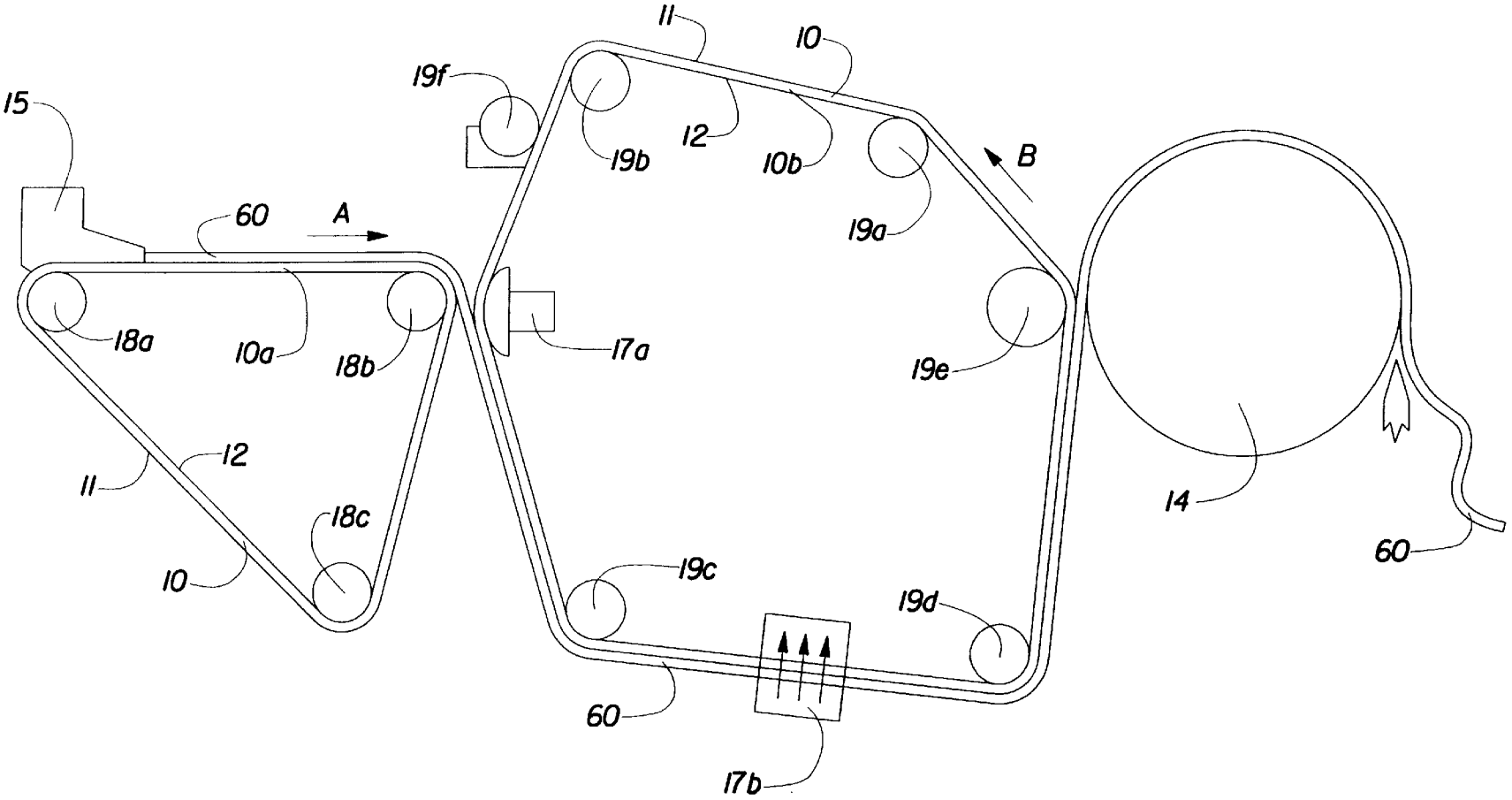
FIG. 6 is a schematic side elevational view of one embodiment of a continuous papermaking process utilized in the present invention.

Referring to FIG. 6, the preferred embodiment of the papermaking belt 10 of the present invention is an endless belt. However, the papermaking belt 10 of the present invention may be incorporated into numerous other forms that include, for example, stationary plates for use in making handsheets or other batch processes, or rotating drums for use with other continuous processes. As used herein, the term "papermaking belt 10," or simply "belt 10" is a generic term which includes both a forming belt 10*a* and a through-air drying belt 10*b*, both shown in FIG. 6. The forming belt 10*a* travels in the direction indicated by a directional arrow "A," and the through-air drying belt 10*b* travels in the direction indicated by a directional arrow "B." Because both the forming belt 10*a* and the through-air drying belt 10*b* possess certain common characteristics, it is convenient in relevant parts of the Specification to refer to both the forming belt 10*a* and the through-air drying belt 10*b* as simply "the belt 10." However, when distinguishing between the forming belt 10*a* and the through-air drying belt 10*b* is necessary or helpful for understanding the present invention, the reference will be made to "the forming belt 10*a*," or to "the through-air drying belt 10*b*." Regardless of the physical form of the papermaking belt 10 and its function in the papermaking process, the belt 10 of the present invention has the characteristics described below.

As shown in FIGS. 1–4C and 6, the belt 10 of the present invention has a web-contacting side 11 and a backside 12 opposite the web-contacting side 11. As should be clear from the definition, the web-contacting side 11 contacts and thereby supports a web 60 on the belt 10. The backside 12 contacts the machinery employed in the papermaking process, such as a vacuum pick-up shoe 17*a* and a multislot vacuum box 17*b* and various rolls, etc. For clarity, as used herein, the web 60 is referenced by the same reference numeral 60, regardless of a particular stage of its processing. The distinction between the various stages of the web's processing, although significant, does not require the use of different reference numerals for the purposes of describing the present invention. An adjective immediately preceding the term "web" will clearly and definitely indicate a particular stage of the web's processing, for example: "embryonic web 60," "intermediate web 60," "imprinted web 60," "predried web 60," "dried web 60," and a final product—"paper web 60."

Figure 1:
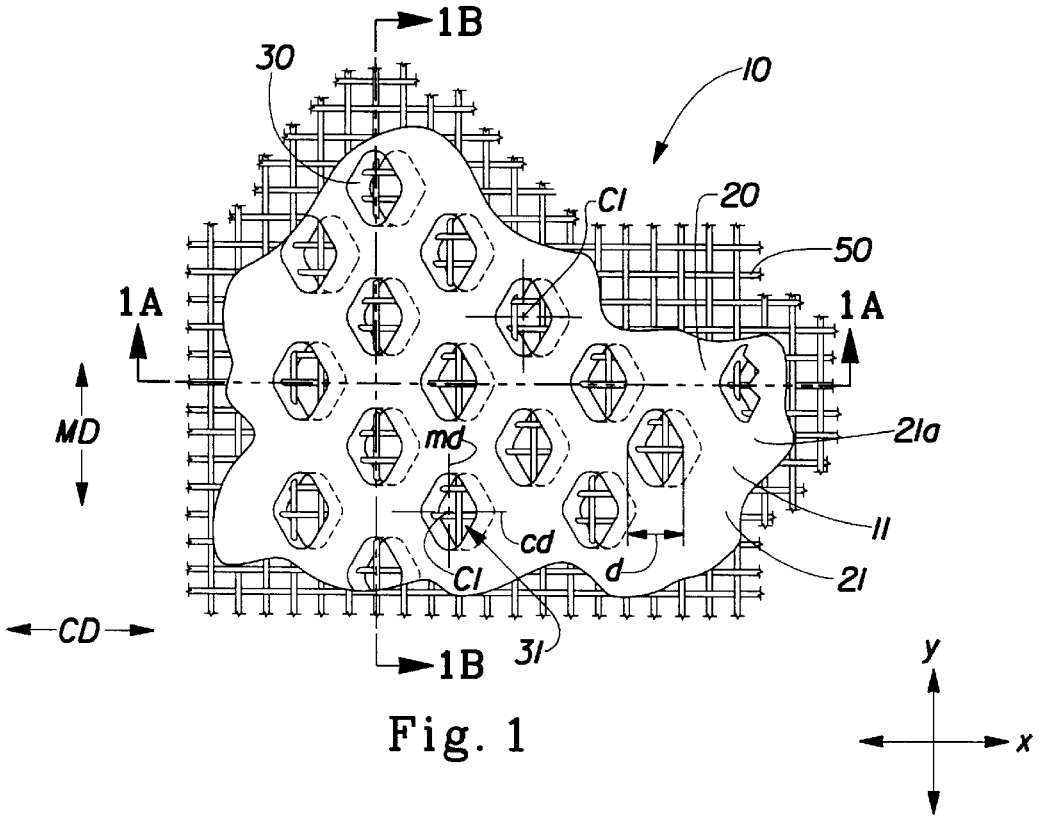
FIG. 1 is a schematic top plan view of a papermaking belt of the present invention having an essentially continuous web-side network and discrete deflection conduits.
Figure 1A:
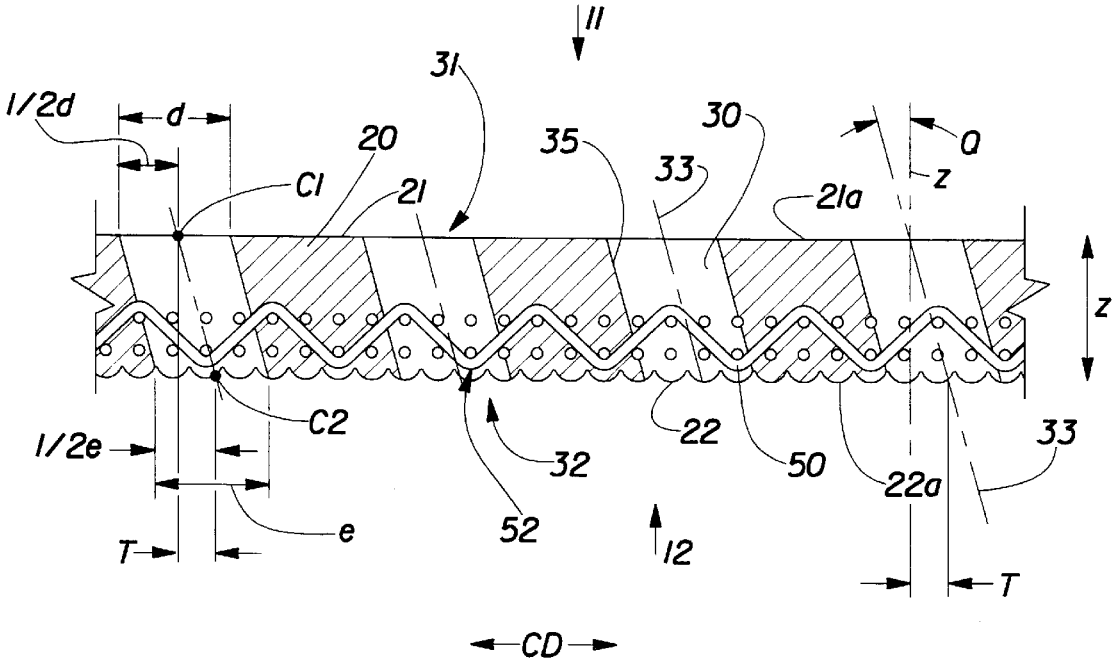
FIG. 1A is a schematic fragmentary cross-sectional view of the papermaking belt taken along lines 1A—1A of FIG. 1, and showing the discrete deflection conduits which are angled relative to the Z-direction.
Figure 1B:
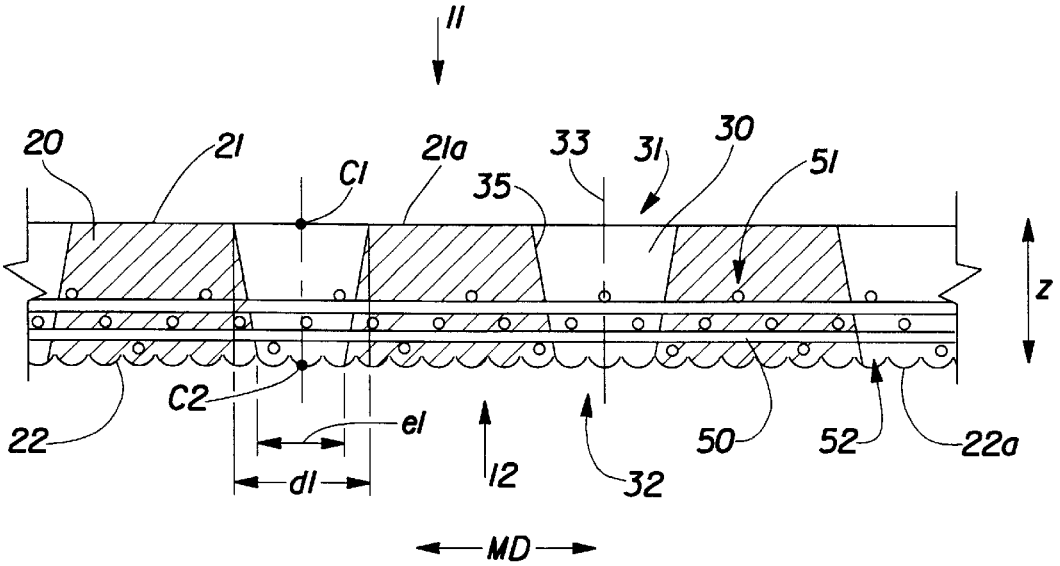
FIG. 1B is a schematic fragmentary cross-sectional view of the papermaking belt taken along lines 1B—1B of FIG. 1.
Figure 1C:
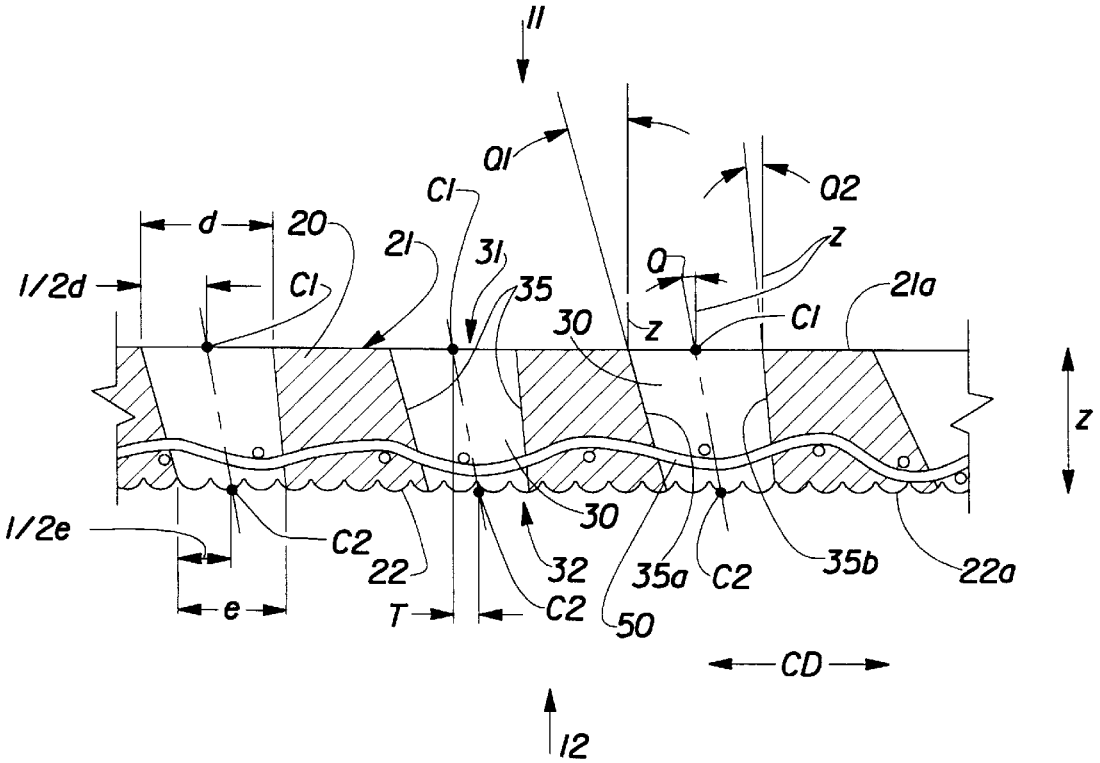
FIG. 1C is a schematic fragmentary cross-sectional view of the papermaking belt of the present invention having angled and negatively tapered conduits.
Figure 2:
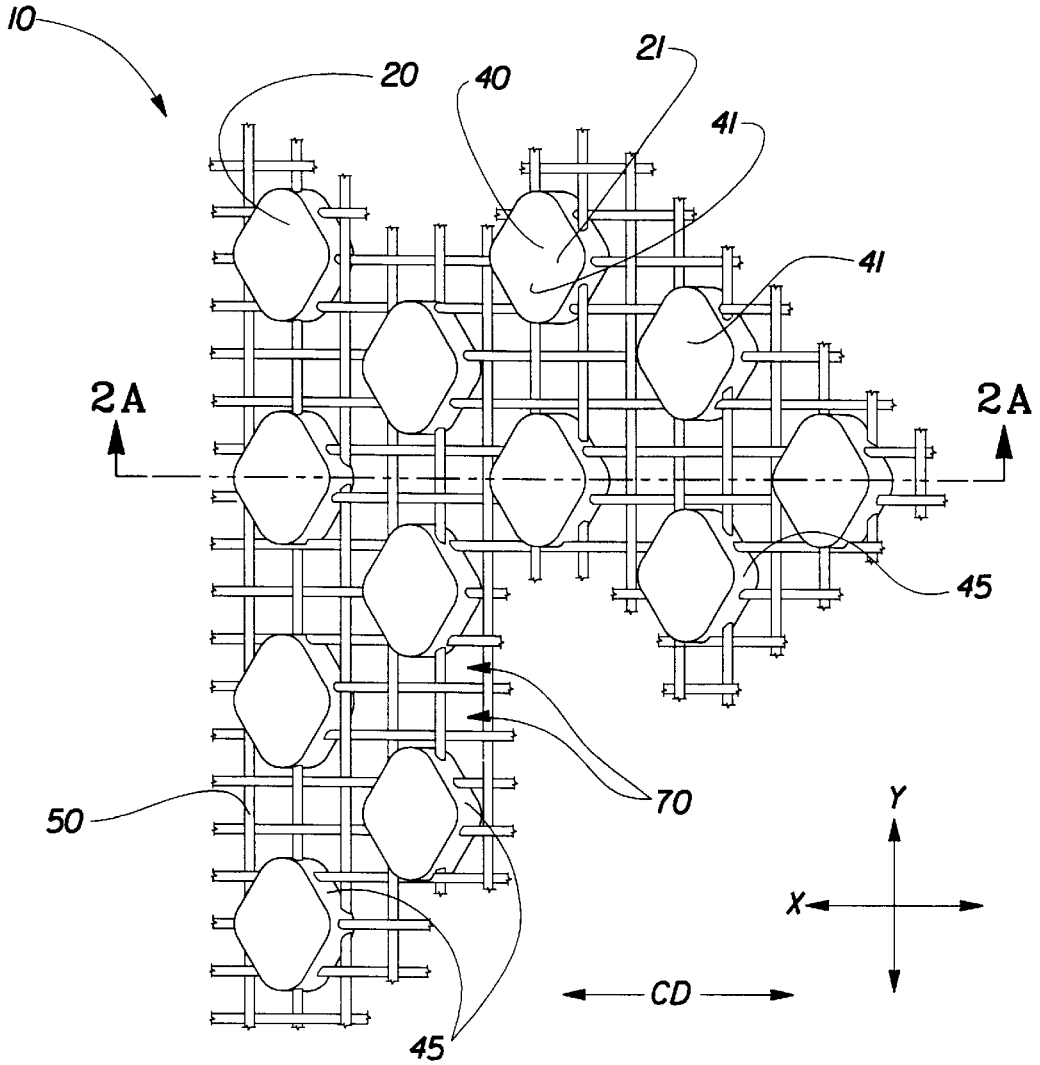
FIG. 2 is a schematic top plan view of the papermaking belt of the present invention comprising a resinous framework formed by discrete protuberances encompassed by an essentially continuous area of deflection conduits.
Figure 3:
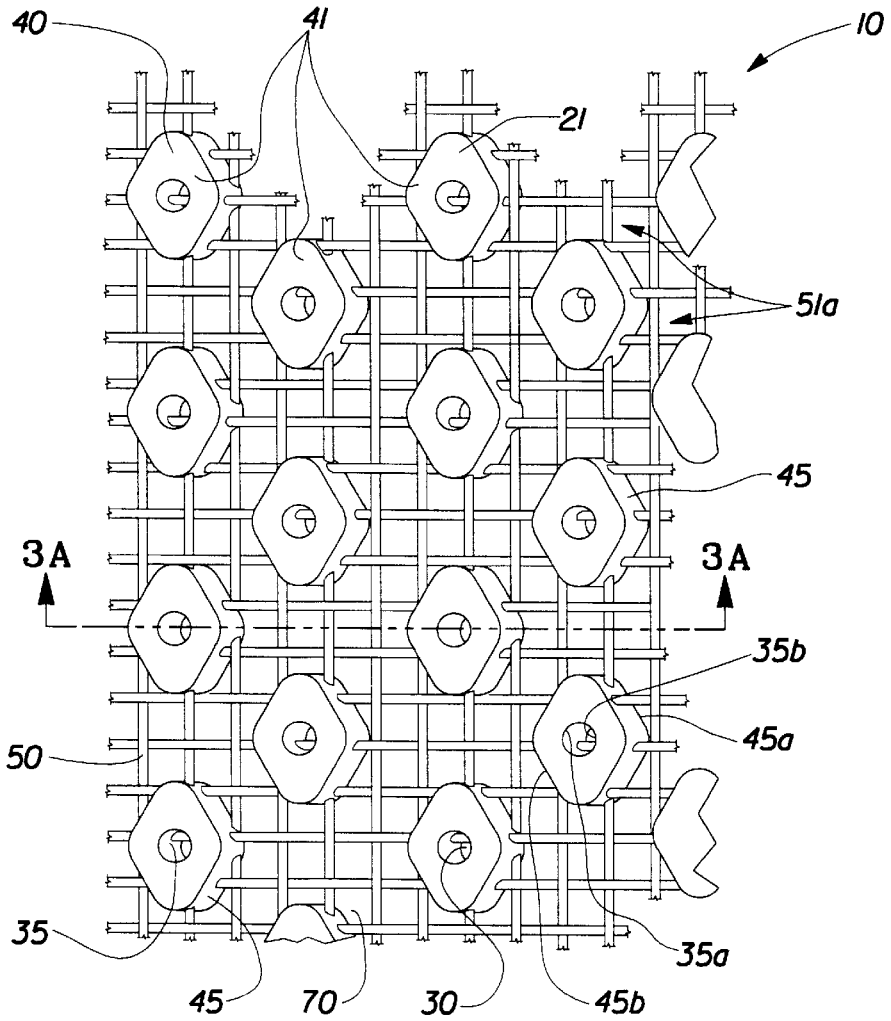
FIG. 3 is a schematic top plan view of a papermaking belt similar to that shown in FIG. 2, and comprising a resinous framework formed by a plurality of discrete protuberances having a plurality of discrete deflection conduits therein.
Figure 3A:
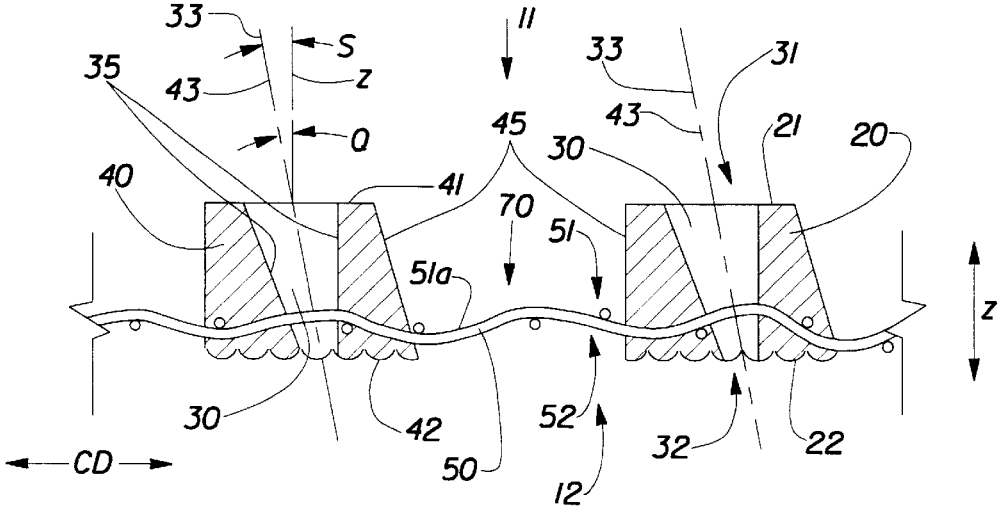
FIG. 3A is a schematic fragmentary cross-sectional view of the papermaking belt taken along lines 3A—3A of FIG. 3, and showing positively tapered protuberances having negatively tapered discrete conduits therein.

FIGS. 1–3C show various embodiments of the belt 10 of the present invention. FIGS. 1–1C illustrate the papermaking belt 10 which may preferably be utilized as the through-air drying belt 10*b*; and FIGS. 2–3A show embodiments of the belt 10 which can preferably be utilized as the forming belt 10*a*. The belt 10 comprises a resinous framework 20 and a reinforcing structure 50 joined to the resinous framework 20. It should be pointed out that the reinforcing structure 50 is necessary for the forming belt 10*a* and highly preferred for the through-air drying belt 10*b*.

The resinous framework, or simply framework, 20 has a web-side surface 21, a backside surface 22 opposite the web-side surface 21, and a plurality of deflection conduits 30 extending between the web-side surface 21 and the backside surface 22. If desired, the backside surface 22 may be textured according to the commonly assigned and incorporated herein by reference U.S. Pat. No. : 5,275,700 issued Jan. 4, 1994 to Trokhan; U.S. Pat. No. 5,334,289 issued Aug. 2, 1994 to Trokhan et al.; U.S. Pat. No. 5,364,504 issued Nov. 15, 1994 to Smurkoski et al. The reinforcing structure 50 is preferably positioned between the web-side surface 21 and the backside surface 22 of the framework 20. The reinforcing structure 50 is substantially liquid-pervious, and may comprise a foraminous element, such as a woven screen or other apertured structures. The reinforcing structure 50 has a web-facing side 51 and a machine-facing side 52 opposite to the web-facing side 51. The web-facing side 51 of the reinforcing structure 50 corresponds to the web-side surface 21 of the framework 20, and the machine-facing side 52 of the reinforcing structure 50 corresponds to the backside surface 22 of the framework 20.

In the embodiment shown in FIGS. 1–1C, the framework 20 comprises an essentially continuous pattern, and the plurality of deflection conduits 30 comprises a plurality of discrete orifices, or holes, extending from the web-side surface 21 to the backside surface 22 of the framework 20. Preferably, the discrete conduits 30 are arranged in a preselected pattern in the framework 20. More preferably, the pattern of the arrangement of the conduits 30 is non-random and repeating. The papermaking belt 10 having a continuous framework 20 and discrete deflection conduits 30 may preferably be utilized as the through-air drying belt 10*b*. The papermaking belt 10 having a continuous framework 20 and discrete deflection conduits 30 is primarily disclosed in the commonly assigned and incorporated by reference herein U.S. Pat. No. 4,528,239 issued Jul. 9, 1985 to Trokhan; U.S. Pat. No. 4,529,480 issued Jul. 16, 1985 to Trokhan; U.S. Pat. No. 4,637,859 issued Jan. 20, 1987 to Trokhan; U.S. Pat. No. 5,098,522 issued Mar. 24, 1992 to Trokhan et al.; U.S. Pat. No. 5,275,700 issued Jan. 4, 1994 to Trokhan; U.S. Pat. No. 5,334,289 issued Aug. 2, 1994 to Trokhan; and U.S. Pat. No. 5,364,504 issued Nov. 15, 1985 to Smurkoski et al.

In another embodiment of the belt 10 shown in FIGS. 2–3C, the framework 20 comprises a plurality of discrete protuberances 40 extending from the reinforcing structure 50 and adjacent to an area of essentially continuous deflection conduits 70. The discrete protuberances 40 are preferably circumscribed by the area of essentially continuous deflection conduits 70. In the embodiments shown in FIGS. 2–3C, the region of essentially continuous deflection conduits 70 preferably defines an essentially continuous web-facing network 51* formed in the web-facing side 51 of the reinforcing structure 50.

The term "essentially continuous" indicates that interruptions in absolute geometrical continuity may be tolerable, while are not preferred, as long as these interruptions do not adversely affect the performance of the belt 10 of the present invention. It should also be carefully noted that embodiments (not shown) are possible in which interruptions in the absolute continuity of the framework 20 (in the through-air drying belt 10*b*) or interruptions in the absolute continuity of the conduits 70 (in the forming belt 10*a*) are intended as a part of the overall design of the belt 10. These embodiments are not illustrated but can easily be visualized by combining the framework's pattern of the through-air drying belt 10*b* with the framework's pattern of the forming belt 10*a* in such a way that some of the areas of the "combined" belt comprise the pattern of the through-air drying belt 10*b*, while the other parts of the same "combined" belt comprise the pattern of the forming belt 10*a*.

As shown in FIGS. 3–3C, the individual protuberances 40 may also have the discrete deflection conduits 30 disposed therein and extending from the web-side surface 21 to the backside surface 22 of the framework 20. The papermaking belt 10 having the framework 20 comprising the discrete protuberances 40 may preferably be utilized as the forming belt 10*a*. The papermaking belt 10 having the framework 20 comprising the discrete protuberances 40 is primarily disclosed in the commonly assigned and incorporated by reference herein U.S. Pat. No. 4,245,025 issued Sep. 14, 1993 to Trokhan et al. and U.S. Pat. No. 5,527,428 issued Jun. 18, 1996 to Trokhan et al. Also, the papermaking belt 10 having the discrete protuberances raised above the plane of the fabric may be made according to the European Patent Application 95105513.6, Publication No.: 0 677 612 A2, filed Dec. 4, 1995, inventor Wendt et al.

The belt 10 is preferably air-permeable and liquid-pervious in at least one direction, particularly the direction from the web-contacting side 11 to the backside 12. As used herein, the term "liquid-pervious" refers to the condition where a liquid carrier of a fibrous slurry may be transmitted through the belt 10 without significant obstruction. It is not, however, necessary, or even desired, that the entire surface area of the belt 10 be liquid-pervious. It is only necessary that the liquid carrier be easily removed from the slurry leaving on the web-contacting side 11 of the belt 10 an embryonic web of the papermaking fibers.

The web-side surface 21 of the framework 20 defines the web-contacting side 11 of the papermaking belt 10; and the machine-facing surface 22 of the framework 20 defines the backside 12 of the papermaking belt 10. Therefore, it also could be said that the discrete deflection conduits 30 and the essentially continuous deflection conduits 70 extend intermediate the web-contacting side 11 of the belt 10 and the backside 12 of the belt 10. The discrete deflection conduits 30 (or simply "conduits 30") and the essentially continuous conduits 70 (or simply "conduits 70") channel water from the web 60 which rests on the web-side surface 21 of the framework 20 to the backside surface 22 of the framework 20 and provide areas into which the fibers of the web 60 can be deflected and rearranged to form dome areas—comprising either discrete domes 65 (FIG. 4) or "continuous domes" forming a first region 64* (FIG. 4D) in the web 60. As used herein, the term "domes" indicates elements of the web 60 formed by the fibers deflected into the deflection conduits 30, 70. The domes 65 generally correspond in geometry and—during the papermaking process—in position to the deflection conduits 30, 70 during the papermaking process. By conforming to the deflection conduits 30, 70 during the papermaking process, the regions of the web 60 comprising the domes 65 are deflected such that the domes 65 protrude outwardly and extend from the general plan of the web 60, thereby increasing a thickness, or caliper, of the web 60 in a Z-direction. As used herein, the Z-direction is orthogonal to the general plane of the web 60 and the belt 10, as illustrated in several Figures of the present Application. Of course, if the papermaking belt 10 having an area of essentially continuous conduits 70 is used, the domes 65 of the paper web 60 will comprise an essentially continuous dome region 65.

Now referring to FIGS. 1–1C, the web-side surface 21 of the essentially continuous resinous framework 20 defines the general plane of the belt 10, or an X-Y plane. Because the web-facing side 51 of the reinforcing structure 50 is generally parallel to the web-side surface 21, the web-facing side 51 may also be viewed as defining the X-Y plane. The Z-direction defined hereinabove is therefore the direction perpendicular to the X-Y plane. The web-side surface 21 of the framework 20 has a web-side network 21* formed therein. Likewise, the backside surface 22 of the framework 20 has a backside network 22* formed therein. Because the discrete conduits 30 extend between the web-side surface 21 and the backside surface 22 of the framework 20, each of the discrete conduits 30 has a pair of openings: a web-side opening 31 and a backside opening 32. The web-side network 21* formed in the web-side surface 21 defines the web-side openings 31 of the conduits 30; and the backside network 22* formed in the backside surface 22 defines the backside openings of the conduits 30.

Each discrete conduit 30 has walls 35 extending between the web-side surface 21 (or the web-side network 21*) and the backside surface 22 (or the backside network 22*). As will be shown below, the walls 35 of the same conduit 30 may form different angles relative to the Z-direction. Each discrete conduit 30 has an axis 33. As used herein, the "axis 33" of the conduit 30 is an imaginary straight line connecting the center C1 of the web-side opening 31 and the center C2 of the backside opening 32. The center C1 of the web-side opening 31 is a center of an X-Y area of the opening 31, i.e., a point of an X-Y plane of the opening 31, which point coincides with the center of mass of a thin uniform distribution of matter over this X-Y plane of the opening 31. Analogously, the center C2 of the backside opening 32 is the center of an X-Y area of the opening 32. One skilled in the art will readily recognize that if the opening 31 comprises a figure that is bilaterally symmetrical relative to an axis parallel to at least one of the X-Y directions, then in a Z-directional (i.e., vertical) cross-section perpendicular to that at least one of the X-Y directions, the center C1 of the web-side opening 31 will be positioned in the middle of a web-side cross-sectional dimension "d" of the web-side opening 31 (FIGS. 1A and 1C). Likewise, if the opening 32 comprises a figure that is bilaterally symmetrical relative to an axis parallel to at least one of the X-Y directions, then in a Z-directional cross-section perpendicular to that at least one of the X-Y directions, the center C2 of the backside opening 32 will be positioned in the middle of a backside cross-sectional dimension "e" of the backside opening 32 (FIGS. 1A and 1C). For example, in the embodiment shown in FIGS. 1–1B, the web-side opening 31 of the conduit 30 comprises a diamond-shape figure bilaterally symmetrical relative to an axis "md" parallel to the machine direction MD. In the Z-directional cross-section perpendicular to MD (or, in other words, in the "vertical CD cross-section") the center C1 of the web-side opening 31 is positioned in the middle of the web-side CD cross-sectional dimension "d," as best shown in FIG. 1A. The backside opening 32 also comprises a diamond-like figure bilaterally symmetrical relative to an axis (not shown) parallel to MD. In the Z-directional cross-section perpendicular to MD (or, in the "vertical CD cross-section"), the center C2 of the backside opening 32 is positioned in the middle of the backside CD cross-sectional dimension "e," as best shown in FIG. 1B. The diamond-like openings 31 and 32 of the conduits shown in FIGS. 1–1C are also bilaterally symmetrical relative to an axes "cd" parallel to the cross-machine direction CD. Therefore, analogously to the "d" and "e" discussed hereabove, in the Z-directional cross-section perpendicular to CD (or in the "vertical MD cross-section"), the centers C1 and C2 of the openings 31 and 32, respectively, are positioned in the middle of their respective MD cross-sectional dimensions "d1" and "e1", as illustrated in FIG. 1B. It should be carefully noted that the web-side openings 31 need not be identical to the corresponding backside openings 32, nor the web-side openings 31 need have the same general shape (for example, circle, or diamond-like shape) as the backside opening 32.

According to the present invention, the web-side openings 31 are off-set relative to the backside openings 32 within the X-Y plane and in at least one direction which is perpendicular to the Z-direction. One skilled in the art will readily recognize that there are infinite directions perpendicular to the Z-direction (or "X-Y directions"), all of which are included in the scope of the present invention. However, for clarity and convenience of illustrating the present invention, the present invention is discussed primarily in the context of the mutually perpendicular machine direction MD and cross-machine direction CD.

In papermaking, the machine direction MD indicates that direction which is parallel to the flow of the web 60 (and therefore the belt 10) through the papermaking equipment. The cross-machine direction CD is perpendicular to the machine direction MD and parallel to the general plane of the belt 10. Both the machine direction MD and the cross-machine direction CD can be viewed as parallel to the X-Y plane. Consequently, the Z-direction is perpendicular to both the MD and the CD.

FIGS. 1A and 1C show that the web-side openings 31 are off-set relative to the corresponding backside openings 32 in the cross-machine direction CD. In FIGS. 1A and 1C a dimension of an off-set is indicated by the symbol "T." As used herein, the "off-set" in the context of the conduit 30 or a protuberance means the distance between the center C1 of the web-side opening 31 and the center C2 of the backside opening 32 measured in, or geometrically projected to, the X-Y plane. If the web-side opening 31 is off-set relative to the backside opening 32 in a direction other than either the MD or the CD, it still may be convenient to define the off-set in the MD and the CD, as mutually perpendicular projections of a real dimension of the off-set to the corresponding MD cross-section and CD cross-section, respectively. Therefore, as used herein, the "MD off-set" indicates a projection of the actual off-set to the MD. Likewise, the "CD off-set" indicates a projection of the actual off-set to the CD.

FIGS. 1–1B and 1C schematically show various embodiments of the papermaking belt 10 of the present invention, comprising the framework 20 which has the discrete conduits 30 therein. In FIGS. 1–1B, the web-side openings 31 are off-set relative to the backside openings 32 in the cross-machine direction CD (FIGS. 1 and 1A). The dimension T and an angle Q formed between the axis 33 and the Z-direction define the CD off-set of the web-side opening 31 relative to the backside opening 32 of the conduit 30.

If the web-side cross-sectional dimension "d" is equal to the backside cross-sectional dimension "e" in a Z-directional (vertical) cross-section parallel to one of the X-Y directions, the opposing walls 35 of the conduit 30 are mutually parallel in that X-Y direction, and the conduit 30 is said to be non-tapered in that X-Y direction. Conversely, if the web-side cross-sectional dimension "d" is not equal to the backside cross-sectional dimension "e" in a Z-directional cross-section parallel to one of the X-Y directions, the opposing walls 35 are not mutually parallel in that X-Y direction, and the conduit 30 is said to be tapered relative to the axis 33 in that X-Y direction. If the web-side cross-sectional dimension "d" is greater than the backside cross-sectional dimension "e" in a Z-directional cross-section parallel to one of the X-Y directions, the conduit 30 is negatively tapered in that X-Y direction. Conversely, if the backside cross-sectional dimension "e" is greater than the web-side cross-sectional dimension "d" in a Z-directional cross-section parallel to one of the X-Y directions, the conduit 30 is positively tapered in that X-Y direction. For example, assuming that in FIG. 1A, the web-side CD cross-sectional dimension "d" is greater than the backside CD cross-sectional dimension "e," the conduit 30 shown in FIG. 1A is negatively tapered in CD. Analogously, the same conduit 30 shown in FIG. 1B is negatively tapered in the MD if d1>d2.

While it is not necessary, it is preferred that the discrete conduits 30 be negatively tapered in both the machine direction MD and the cross-machine direction CD. It should be carefully noted that while the embodiment illustrated in FIGS. 1–1C comprises the framework 20 having the discrete conduits 30 which are tapered in both the mutually perpendicular MD and CD, an embodiment is possible, in which the discrete conduits 30 are tapered only in one of the MD or CD. This embodiment can easily be visualized by one skilled in the art by assuming that the dimensions "d" and "e" in FIG. 1A are equal, and the dimensions "d1" and "e1" in FIG. 1B are not equal (i. e., d=e, and d1>e1). Then, the discrete conduits 30 will be tapered in the MD (FIG. 1B) and non-tapered in the CD (FIG. 1A). An embodiment (not shown) is also possible, while not preferred, in which the conduits 30 are negatively tapered in one of the X-Y directions, and are positively tapered in the other of the X-Y directions.

Another way of defining the tapered conduits 30 is illustrated in FIG. 1C. In FIG. 1C, the Z-direction and the axis 33 of the conduit 30 form the angle Q therebetween. The web-side CD cross-sectional dimension "d" is greater than the backside CD cross-sectional dimension "e." Therefore, an angle Q1 formed in the CD cross-section between the Z-direction and a wall 35*a* of the conduit 30 is greater than an angle Q2 formed in the CD cross-section between the Z-direction and a wall 35*b* of the conduit 30, opposite to the wall 35*a* in the cross-section.

FIGS. 2–3C illustrate other embodiments of the papermaking belt 10 of the present invention. In the embodiments shown in FIGS. 2–3C, the resinous framework 20 of the belt 10 comprises a plurality of discrete protuberances 40, preferably forming a patterned array. The plurality of protuberances 40 is joined to the reinforcing structure 50 and preferably comprises individual protuberances 40 joined to and extending outwardly from the web-facing side 51 of the reinforcing structure 50. In the embodiments illustrated in FIGS. 2–3C, the web-facing side 51 of the reinforcing structure defines the X-Y plane. Each protuberance 40 has a top surface 41, a base surface 42 opposite the top surface 41, and walls 45 spacing apart and interconnecting the top surface 41 and the base surface 42. The plurality of the top surfaces 41 define the web-side surface 21 of the framework 20; and the plurality of the base surfaces 42 define the backside surface 22 of the framework 20.

Figure 2A:
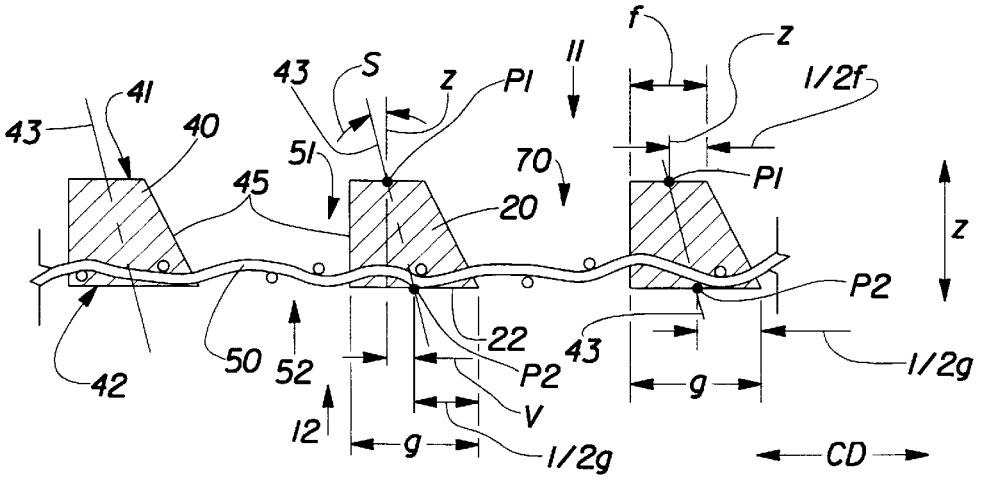
FIG. 2A is a schematic fragmentary cross-sectional view of the papermaking belt taken along lines 2A—2A of FIG. 2, and showing the discrete protuberances which are angled relative to the Z-direction and positively tapered.

As illustrated in FIGS. 2 and 2A, the plurality of protuberances 40 are arranged such that the protuberances 40 are preferably encompassed by and adjacent to the area of essentially continuous conduits 70 which extends from the top surfaces 41 of the protuberances 40 to the web-facing side 51 of the reinforcing structure 50. As used herein, the "area of essentially continuous conduits 70" defines an area between the adjacent protuberances 40 into which the fibers of the web 60 can deflect during the papermaking process according to the present invention. The area of essentially continuous conduits 70 has a defined flow resistance which is dependent primarily upon the pattern, size, and spacing of the individual protuberances and of the reinforcing structure 50. In the preferred embodiment, each protuberance 40 is substantially equally spaced from the adjacent protuberance 40, providing an essentially continuous conduit 70 preferably having substantially uniform flow resistance characteristics. If desired, the protuberances 40 may be clustered together so that one or more protuberances 40 is unequally spaced from an adjacent protuberance 40.

The web-facing side 51 of the reinforcing structure 50 has an essentially continuous web-facing network 51* formed therein and defined by the area of essentially continuous conduits 70. Preferably, the protuberances 40 are distributed in a non-random repeating pattern so that the fibers deposited onto the essentially continuous web-facing network 51* around and between the protuberances 40 are distributed more uniformly throughout the web-facing network 51*. More preferably, the protuberances 40 are bilaterally staggered in an array.

The belt 10 of the present invention is essentially macroscopically monoplanar. As used herein, the requirement that the belt 10 is "essentially macroscopically monoplanar" refers to the overall geometry of the belt 10 when it is placed in a two-dimensional configuration and has, as a whole, only minor and tolerable deviations from the absolute planarity, which deviations do not adversely affect the belt's performance. The possible pre-determined differences in height among the protuberances 40 are considered minor relative to the overall dimensions of the belt 10 and do not affect the belt 10 being macroscopically monoplanar.

Each protuberance 40 has an axis 43. Analogously to the axis 33 of the discrete conduit 30 defined in great detail above, the axis 43 of the individual protuberance 40 is an imaginary straight line connecting a center P1 of the top surface 41 and a center P2 of the base surface 42 (FIG. 2A). The center P1 of the top surface 41 is a center of the top surface 41, i.e., a point of the top surface 41, which point would coincide with the center of mass of a thin uniform distribution of matter over this top surface 41. Analogously, the center P2 of the base surface 42 is a center of the base surface 42. By analogy with the discrete conduits 30, if the top surface 41 comprises a figure that is bilaterally symmetrical relative to an axis (not shown) parallel to at least one of the X-Y directions, then in a Z-directional (i.e., vertical) cross-section perpendicular to that X-Y direction, the top surface center P1 will be positioned in the middle of a cross-sectional dimension "f" of the area of the top surface 41, as shown in FIG. 2. Likewise, if the base surface 42 comprises a figure that is bilaterally symmetrical relative to an axis (not shown) parallel to at least one of the X-Y directions, in a Z-directional cross-section perpendicular to that X-Y direction, the base surface center P2 will be positioned in the middle of a cross-sectional dimension "g" of the area of the base surface 42.

In accordance with the present invention, the Z-direction and the axes 43 of at least some of the protuberances 40 form an acute angle S therebetween, as shown in FIG. 2A. The top surfaces 41 of at least some of the protuberances are off-set relative to the corresponding base surfaces 42 of the same protuberances within the X-Y plane and in at least one direction which is perpendicular to the Z-direction.

In FIGS. 2 and 2A, the top surfaces 41 are off-set relative to the base surfaces 42 in the cross-machine direction CD. An X-Y distance "V" between the top surface center P1 and the base surface center P2, and an angle S formed between the axis 43 and the Z-direction define the off-set of the top surface 41 relative to the base surface 42.

If the top surface cross-sectional dimension "f" is equal to the base surface cross-sectional dimension "g" in a Z-directional (vertical) cross-section parallel to one of the X-Y directions, the opposing walls 45 are mutually parallel, and the protuberance 40 is non-tapered in that X-Y direction. Conversely, if the top surface cross-sectional dimension "f" is not equal to the base surface cross-sectional dimension "g" in a Z-directional cross-section parallel to one of the X-Y directions, the opposing walls 45 are not mutually parallel in that X-Y direction, and the protuberance 40 is tapered relative to the axis 43 in that X-Y direction. If the top surface cross-sectional dimension "f" is smaller than the base surface cross-sectional dimension "g" in a Z-directional cross-section parallel to one of the X-Y directions, the protuberance 40 is positively tapered in that X-Y direction. If the top surface cross-sectional dimension "f" is greater than the base surface cross-sectional dimension "g" in a Z-directional cross-section parallel to one of the X-Y directions, the protuberance 40 is negatively tapered in that X-Y direction. For example, assuming that in FIG. 2A, the top surface cross-sectional CD dimension "f" is smaller than the base surface cross-sectional CD dimension "g," the protuberances 40 shown in FIG. 2A are positively tapered in CD.

While it is not necessary, it is preferred that if the framework 20 comprising the tapered discrete protuberances 40 is to be utilized, the discrete protuberances 40 be positively tapered in both the machine direction MD and the cross-machine direction CD. However, the embodiment is possible, in which the discrete protuberances 40 are tapered only in one of the MD and CD.

Referring now to FIGS. 3 and 3A, the plurality of discrete protuberances 40 may have a plurality of discrete deflection conduits 30 therein. The discrete deflection conduits 30 extend from the web-side surface 21 to the backside surface 22 of the framework 20, or, in other words, from the top surfaces 41 to the base surfaces 42 of the protuberances 40, because, as has been explained hereinabove, the plurality of top surfaces 41 form the web-side surface 21 of the resinous framework 20, and the plurality of base surfaces 42 form the backside surface 22 of the framework 20. Preferably, each individual protuberance 40 has one discrete conduit 30 extending from the top surface 41 to the base surface 42.

As has been described hereinabove, each discrete conduit 30 has the web-side opening 31 and the backside opening 32. The web-side openings 31 are preferably off-set relative to the corresponding backside openings 32 in one of the X-Y direction. In the belt 10 of the present invention, having the framework 20 comprising the discrete protuberances 40 which have the discrete conduits 30 therein, the off-sets of the protuberances 40 are preferably, while not necessarily, coincidental with the off-sets of the conduits 30 disposed in the corresponding protuberances 40. As shown in FIG. 3A, the axes 33 of the discrete conduits 30 are preferably coincidental with the axes 43 of the protuberances 40, and the angles Q formed by the axes 33 and the Z-direction are preferably equal to the corresponding angles S formed by the axes 43 and the Z-direction. In FIG. 3A, the protuberances 40 are positively tapered, and the discrete conduits 30 disposed in the protuberances 40 are negatively tapered.

An embodiment (not shown) is possible, although not preferred, in which the axis 33 of the discrete conduit 30 is not coincidental with the axis 43 of the protuberance 40, and the angle Q formed by the axis 33 and the Z-direction is not equal to the angle S formed by the axis 43 and the Z-direction. The respective off-sets of the protuberance 40 and the discrete conduit 30 may not be equal in the latter case.

The flow resistance of the discrete conduits 30 through the protuberance 40 is different from, and typically greater than, the flow resistance of the essentially continuous conduits 70 between adjacent protuberances 40. Therefore, when the belt 10 having both the discrete conduits 30 and the essentially continuous conduits 70 is utilized as a forming belt 10*a*, typically more of the liquid carrier will drain through the continuous conduits 70 than through the discrete conduits 30, and consequently, relatively more fibers will be deposited onto the areas of the reinforcing structure 50 which are subjacent to the continuous conduits 70 (i.e., the web-facing network 51*) than onto the areas of the reinforcing structure 50 which are subjacent to the discrete conduits 30.

The essentially continuous conduits 70 and the discrete conduits 30, respectively, define high flow rate and low flow rate zones in the belt 10. The initial mass flow rate of the liquid carrier through the continuous conduits 70 is preferably greater than the initial mass flow rate of the liquid carrier through the discrete conduits 30.

It should be recognized that no liquid carrier will flow through the protuberances 40, because the protuberances 40 are impervious to the liquid carrier. However, depending upon the elevation of the top surface 41 of the protuberances 40 relative to the web-facing side 51 of the reinforcing structure 50 and the length of the cellulosic fibers, cellulosic fibers may be deposited on the top surfaces 41 of the protuberances 40.

As used herein, the "initial mass flow rate" refers to the flow rate of the liquid carrier when the liquid carrier is first introduced to and deposited upon the forming belt 10*a*. Of course, it will be recognized that both flow rate zones will decrease in mass flow rate as a function of time as the discrete conduits 30 or the essentially continuous conduits 70 become obturated with cellulosic fibers suspended in the liquid carrier and retained by the belt 10*a*. The difference in flow resistance between the discrete conduits 30 and the continuous conduits 70 provides a means for retaining different basis weights of cellulosic fibers in a pattern in the different zones of the belt 10*a*.

This difference in flow rates through the zones is referred to as "staged draining," in recognition that a step discontinuity exists between the initial flow rate of the liquid carrier through the high flow rate zones and the low flow rate zones. The more detailed description of the staged draining and its benefits may be found in the commonly assigned U.S. Pat. No. 5,245,025 referenced above and incorporated herein by reference.

The papermaking belt 10 of the present invention may be made according to the method comprising the following steps.

First, an apparatus for generating curing radiation should be provided. One embodiment of the apparatus for generating curing radiation is an apparatus 80 for generating curing radiation R in at least a first radiating direction U1. The apparatus 80 schematically shown in FIG. 5 comprises two primary elements: an elongate reflector 82 and an elongate source of radiation 85. Several embodiments of the apparatus 80 for generating curing radiation R are disclosed in the commonly assigned co-pending Application entitled "Apparatus for Generating Controlled Radiation for Curing Photosensitive Resin" filed in the name of Trokhan on the same date as the present application, which application is incorporated herein by reference for the purpose of showing the apparatus 80 which may be utilized in the process of making the belt 10 of the present invention.

Then, a liquid photosensitive resin should be provided. The suitable photosensitive resin is disclosed in the commonly assigned U.S. Pat. No. 5,514,523, issued on Dec. 20, 1993 to P. D. Trokhan et al., which patent is incorporated by reference herein.

The next step is providing a forming unit 87 having a working surface 88. The forming unit 87 should be capable of receiving the liquid photosensitive resin.

The next step is providing the air-permeable reinforcing structure 50 described hereinabove. If the preferred papermaking belt 10 is to be manufactured in the form of endless belt, the reinforcing structure 50 should also be an endless belt. It should be noted that the step of providing the reinforcing structure 50 is necessary for the belt 10 having the framework 20 which is comprised of the plurality of discrete protuberances 40. In the case of manufacturing the belt 10 comprising the essentially continuous framework 20, the reinforcing structure 50 is not necessary, although highly preferred.

If the reinforcing structure 50 is to be utilized, the next steps are bringing at least a portion of the machine-facing side 52 of the reinforcing structure 50 into contact with the working surface 88 of the forming unit 80, and applying a coating of the liquid photosensitive resin to at least the web-facing side 51 of the reinforcing structure 50. The coating has a pre-selected thickness, and after the coating is applied to the reinforcing structure 50, the coating forms a first surface 25 and a second surface 27 opposite the first surface 25. After the process of curing is complete, the first surface 25 will form the web-side surface 21 of the framework 20, and the second surface 27 will form the backside surface 22 of the framework 20. The steps of bringing a portion of the machine-facing side 52 of the reinforcing structure 50 into contact with the working surface 88 and applying a coating of the resin to the web-facing side 51 of the reinforcing structure 50 are described in greater detail in the above-mentioned U.S. Pat. No. 5,514,523.

If the reinforcing structure 50 is not to be utilized, the liquid photosensitive resin may simply be disposed in the forming unit 87 thereby forming a coating of the resin of a pre-selected thickness, the coating having the first surface 25 and the second surface 27 opposite the first surface 25.

Figure 5:
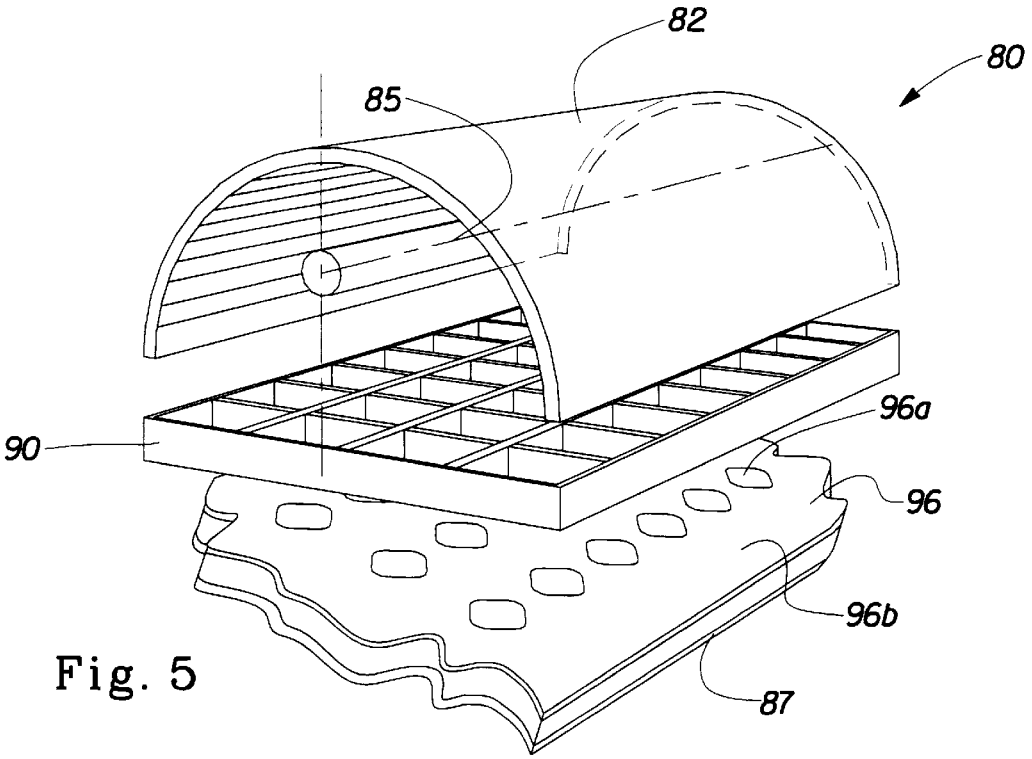
FIG. 5 is a schematic perspective view of an apparatus for generating curing radiation which can be utilized for curing a photosensitive resin to form a resinous framework comprising the papermaking belt of the present invention.
Figure 5A:
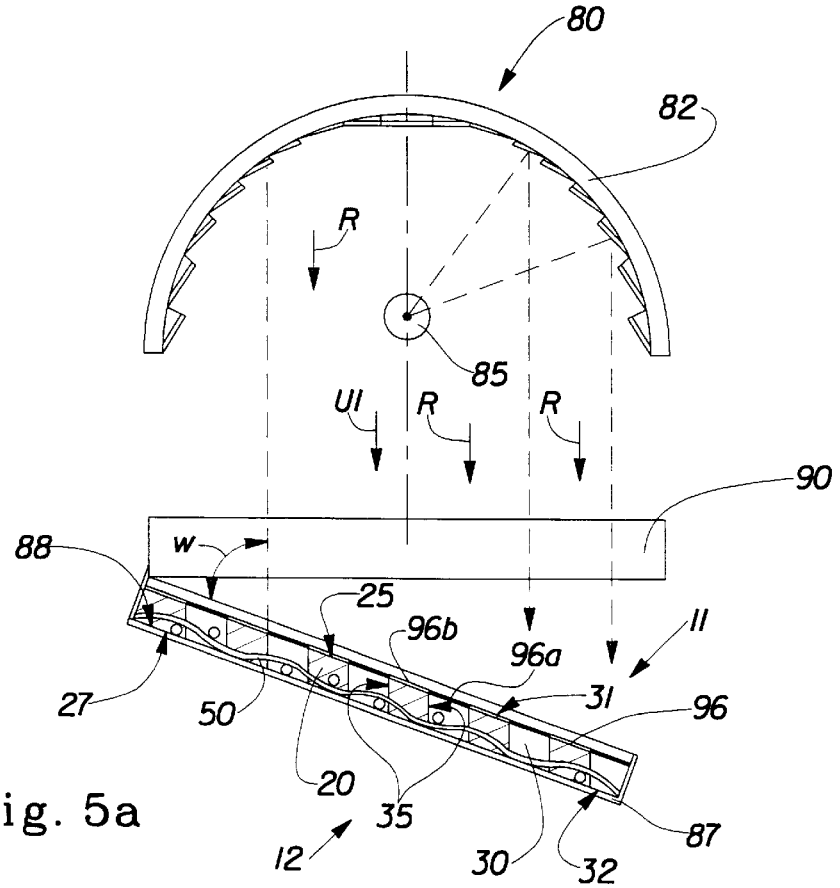
FIG. 5A is a schematic cross-sectional view of the apparatus shown in FIG. 5.

After the coating of the liquid photosensitive resin has been formed (with or without the reinforcing structure 50), the next step is disposing the forming unit 87 containing the coating of the liquid photosensitive resin in the first radiating direction U1 such that the first surface 25 of the coating and the first radiating direction U1 form an acute angle W therebetween. This step may be accomplished by positioning the coating of the resin as schematically shown in FIG. 5A. If desired, the angle of incidence of the curing radiation may be parallel to the axis through the collimator 90 (FIGS. 5 and 5A).

The critical point is that the resin coating is maintained in acute angular relationship with the direction of the radiation during the curing process. The angular relationship may be accomplished by adjusting either the position of the resin or the direction of the radiation, so that perpendicularity is avoided and an acute angle obtained.

Figure 5B:
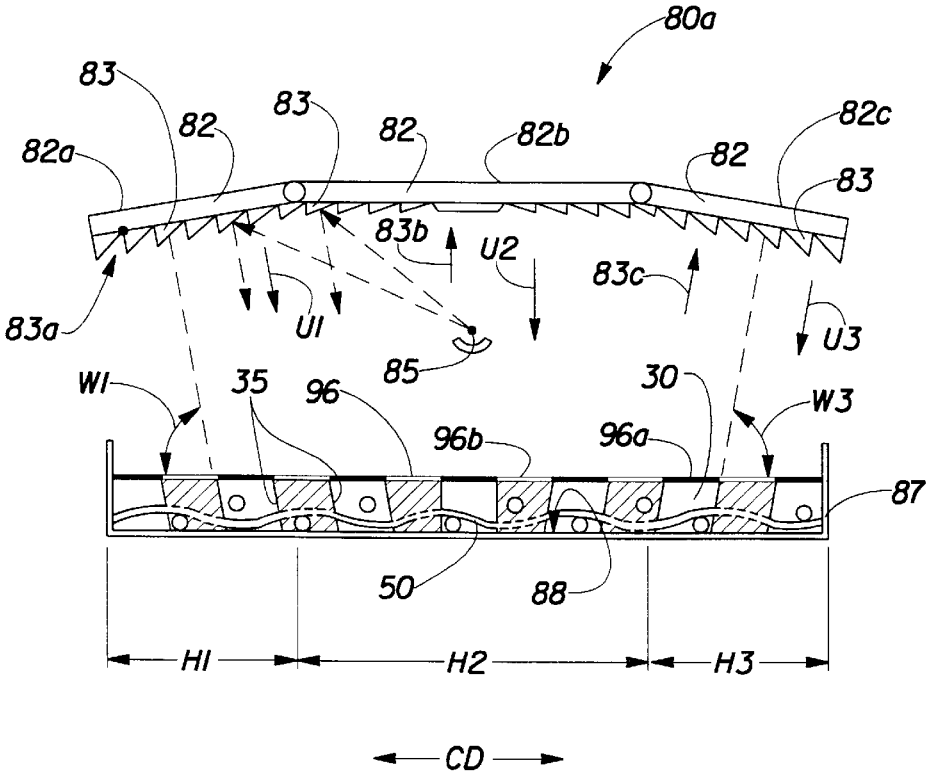
FIG. 5B is a schematic cross-sectional view of the apparatus of controlled radiation directing curing radiation in more than one pre-determined radiating direction.

Alternatively or additionally, this step may be accomplished by utilizing an apparatus of controlled radiation 80*
schematically shown in FIG. 5B and disclosed in the co-pending and commonly assigned Application entitled "Apparatus for Generating Controlled Radiation for Curing Photosensitive Resin" filed in the name of Trokhan on the same date as the present application and incorporated herein by reference. The apparatus of controlled radiation 80* schematically shown in FIG. 5B comprises three sections 82: 82*a*, 82*b*, 82*c*. The section 82*b* is movably connected to the section 82*a*, and the section 82*c* is movably connected to the section 82*b*. Each section 82 (82*a*, 82*b*, 82*c*) comprises a plurality of reflective facets 83 (83*a*, 83*b*, 83*c*, respectively). Each individual reflective facet 83 is independently adjustable in the cross-section. The source of radiation 85 is movable in the cross-section.

The combination of independent adjustability of the individual reflective facets 83 and the independent adjustability of the individual sections 82 combined with the movability of the source of radiation 85 allows to direct the curing radiation generated by the apparatus 80* in at least one pre-determined radiating direction in the cross-section. In FIG. 5B, the apparatus 80* directs the curing radiation in the first radiating direction U1, a second radiating direction U2, and a third radiating direction U3.

Figure 5C:
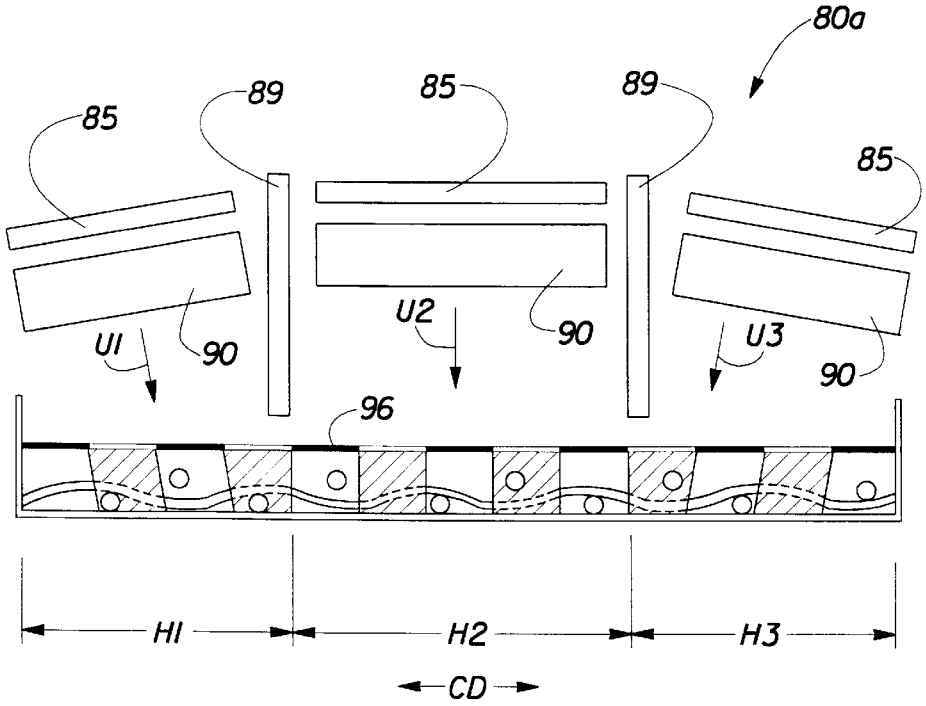
FIG. 5C is a schematic cross-sectional view of another embodiment of the apparatus of controlled radiation.

FIG. 5C shows another embodiment of the apparatus of controlled radiation 80*. The apparatus 89 shown in FIG. 5C comprises several sources of radiation, preferably bulbs, 85. Each bulb 85 has its longitudinal direction essentially perpendicular to the machine direction MD. Each bulb 85 has its own collimating element 90 disposed between the bulb 85 and the photosensitive resin being cured. The collimating elements 90 are disposed such that the curing radiation emitted by each bulb has its own predetermined direction (U1, U2, U3, as schematically shown in FIG. 5C). Subtractive walls 89 are preferably provided to restrict the mutual interference between the portions of the curing radiation having different directions U1, U2, U3.

The embodiments of the apparatus 80* shown in FIGS. 5B and 5C prophetically produce the belts 10 having sophisticated three-dimensional designs of the resinous framework 20. In FIGS. 5B and 5C, for example, the resin being cured by the apparatus 80* will form the framework 20 having three zones H1, H2, and H3 distinguished by relative "angled" orientations of the discrete conduits 30 (or the discrete protuberances 40 in the case of the forming belt 10*a*).

The next step is providing a mask 96 having opaque regions 96*a* and transparent regions 96*b*. The purpose of the mask is to shield certain areas of the liquid photosensitive resin from exposure to the curing radiation R so that these shielded areas will not be cured, i. e., will remain fluid, and will be removed after curing is completed. The unshielded areas of the liquid photosensitive resin will be exposed to the curing radiation R to form the hardened framework 20. The opaque regions 96*a* and the transparent regions 96*b* define a pre-selected pattern corresponding to a specific desired design of the resinous framework 20. If, for example, the belt 10 having a substantially continuous resinous framework 20 is to be produced, the transparent regions 96*b* must form a continuous area generally corresponding to the X-Y plane of the desired web-side network 21* of the framework 20.

The next step is positioning the mask 96 between the first surface 25 of the resin coating and the apparatus 80 such that the mask 96 is preferably in adjacent relation with the first surface 25. The opaque regions 96*a* of the mask shield a portion of the coating from the curing radiation R, and the transparent regions 96*b* leave the other portions of the coating unshielded for the curing radiation R.

The next step is curing of the unshielded portions of the coating by exposing the coating to the curing radiation R having an activating wavelength from the apparatus 80 through the mask 96 to form a partially-formed belt, and leaving the shielded portions of the coating uncured.

The final step is removing substantially all uncured liquid photosensitive resin from the partially-formed belt to leave a hardened resinous structure. This hardened resinous structure forms a framework 20 having a web-side surface 21 formed by the first surface 25 being cured, and a backside surface 22 formed by the second surface 27 being cured.

In the case of the belt 10 comprising a continuous framework 20, the framework 20 has a plurality of discrete conduits 30 in the regions which were shielded from the curing radiation R by the opaque regions 96*a* of the mask 96. The discrete conduits 30 extend between the web-side surface 22 (or the cured first surface 25) and the backside surface 27 (or the cured second surface 27), each of the conduits 30 having the axis 33 and the walls 35, the axes of at least some of the conduits and the Z-direction forming an acute angles therebetween, as has been described in greater detail above.

In the case of the belt 10 having the framework 20 comprising the plurality of discrete protuberances 40, the plurality of discrete protuberances 40 extends from the reinforcing structure 50, each of the protuberances having the axis 43, the base surface 42, the top surface 41, and the walls 45 spacing apart and interconnecting the base surface 41 and the top surface 42. The plurality of the top surfaces 41 define the web-side surface 21 of the resinous framework 20, and the plurality of base surfaces 42 define the backside surface 22 of the resinous framework 20. The axes 43 of at least some of the protuberances 40 and the Z-direction form acute angles therebetween, as has been described in greater detail above.

The papermaking process which utilizes the papermaking belt 10 of the present invention is described below, although it is contemplated that other processes utilizing the belt 10 may also be used. By way of background it should be appreciated that the belt 10 comprising the resinous framework 20 which is substantially continuous is primarily utilized as a through-air drying belt 10*b*, while the belt 10 comprising the framework 20 in the form of the plurality of discrete protuberances 40 is primarily utilized as a forming wire 10*a*, as schematically illustrated in FIG. 6. It does not exclude, however, the alternative uses, i.e., that the belt 10 comprising the substantially continuous resinous framework 20 may be used as a forming belt 10*a*, and the belt 10 comprising the resinous framework 20 in the form of the plurality of discrete protuberances 40 may be used as a through-air drying belt 10*b*.

The overall papermaking process which uses the papermaking belt 10 of the present invention comprises a number of steps or operations which occur in the general sequence as noted below. It is to be understood, however, that the steps described below are intended to assist a reader in understanding the process of the present invention, and that the invention is not limited to processes with only a certain number or arrangement of steps. In this regard, it is noted that it is possible to combine at least some of the following steps so that they are performed concurrently. Likewise, it is possible to separate at least some of the following steps into two or more steps without departing from the scope of this invention.

FIG. 6 is a simplified, schematic representation of one embodiment of a continuous papermaking machine useful in the practice of the papermaking process of the present invention. As has been defined above, the papermaking belt 10 of the present invention includes the forming belt 10*a* and the through-air drying belt 10*b*, both shown in the preferred form of endless belts in FIG. 6.

The first step is to provide a plurality of cellulosic fibers entrained in a liquid carrier, or, in other words, an aqueous dispersion of papermaking fibers. The cellulosic fibers are not dissolved in the liquid carrier, but merely suspended therein. The equipment for preparing the aqueous dispersion of papermaking fibers is well-known in the papermaking art and is therefore not shown in FIG. 6. The aqueous dispersion of papermaking fibers is provided to a headbox 15. A single headbox is shown in FIG. 6. However, it is to be understood that there may be multiple headboxes in alternative arrangements of the papermaking process of the present invention. The headbox(es) and the equipment for preparing the aqueous dispersion of papermaking fibers are preferably of the type disclosed in U.S. Pat. No. 3,994,771, issued to Morgan and Rich on Nov. 30, 1976, which is incorporated by reference herein. The preparation of the aqueous dispersion and the characteristics of the aqueous dispersion are described in greater detail in U.S. Pat. No. 4,529,480 issued to Trokhan on Jul. 16, 1985, which is incorporated herein by reference.

The aqueous dispersion of papermaking fibers supplied by the headbox 15 is delivered to a forming belt, such as the forming belt 10*a* of the present invention, for carrying out the second step of the papermaking process. The forming belt 10*a* is supported by a breast roll 18*a* and a plurality of return rolls designated as 18*b* and 18*c*. The forming wire 10*a* is propelled in the direction indicated by the directional arrow A by a conventional drive means well known to one skilled in the art and therefore not shown in FIG. 6. There may also be associated with the papermaking machine shown in FIG. 6 optional auxiliary units and devices which are commonly associated with papermaking machines and with forming belts, including: forming boards, hydrofoils, vacuum boxes, tension rolls, support rolls, wire cleaning showers, and the like, which are conventional and well-known in the papermaking art, and therefore also not shown in FIG. 6.

The preferred forming belt 10*a* is the macroscopically monoplanar belt comprising the air-permeable reinforcing structure 50 and the resinous framework 20 joined to the reinforcing structure 50. As has been described above, the reinforcing structure 50 has the web-facing side 51 and the machine-facing side 52 opposite the machine-facing side 51. The web-facing side 51 defines the X-Y plane of the forming belt 10, this X-Y plane being perpendicular to the Z-direction. The framework 20 is comprised of the plurality of discrete protuberances 40 joined to and extending from the reinforcing structure 50. Each of the protuberances 40 has the top surface 41, the base surface 42, the walls 45 spacing apart and interconnecting the top surface 41 and the base surface 42, and the axis 43 connecting the center of the top surface 41 and the center of the base surface 42. The plurality of top surfaces 42 define the web-side surface 21, and the plurality of base surfaces 42 define the backside surface 22 of the framework 20. In accordance with the present invention, the axes 43 of at least some of the protuberances 40 and the Z-direction form acute angles S therebetween.

If the forming belt 10*a* has the area of essentially continuous conduits 70 and the plurality of discrete deflection conduits 30 disposed in the protuberances 40, the belt 10*a* has high flow rate liquid pervious zones and low flow rate liquid pervious zones respectively defined by the essentially continuous deflection conduits 70 and the discrete conduits 30. The liquid carrier and entrained cellulosic fibers are deposited onto the forming belt 10*a* illustrated in FIG. 6. The liquid carrier is drained through the forming belt 10*a* in two simultaneous stages, a high flow rate stage and a low flow rate stage. In the high flow rate stage, the liquid carrier drains through the liquid pervious high flow rate zones at a given initial flow rate until obturation occurs (or the liquid carrier is no longer introduced to this portion of the forming belt 10). In the low flow rate stage, the liquid carrier drains through low flow rate zones of the forming belt 10*a* at a given initial flow rate which is less than the initial flow rate through the high flow rate zones.

As has been noted above, the high flow rate liquid pervious zones and the low flow rate liquid pervious zones in the belt 10*a* decrease as a function of time, due to expected obturation of both zones. It is believed that the low flow rate zones may obturate before the high flow rate zones obturate.

Without being bound by theory, the Applicant believes that the first occurring zone obturation may be due to the lesser hydraulic radius and greater flow resistance of such zones, based upon factors such as the flow area, wetted perimeter, shape and distribution of the low flow rate zones, or may be due to a greater flow rate through such zone accompanied by a greater depiction of fibers. The low flow rate zones may, for example, comprise discrete conduits 30 through the protuberances 40, which discrete conduits 30 have a greater flow resistance than the essentially continuous conduits 70 between adjacent protuberances 40. It is important that the ratio of the flow resistances between the discrete conduits 30 and the essentially continuous conduits 70 be properly proportioned. The flow resistance of the discrete conduits 30 and the essentially continuous conduits 70 may be determined by using the hydraulic radius, as described in the commonly assigned and incorporated herein U.S. Pat. No. 5,527,428 referenced above.

The next steps are depositing the plurality of cellulosic papermaking fibers suspended in a liquid carrier on the forming belt 10*a* and draining the liquid carrier through the forming belt thereby forming an embryonic web 60 of the papermaking fibers on the forming belt 10*a*. As used herein, the "embryonic web" is the web of fibers which is subjected to rearrangement on the forming belt, and preferably the forming belt 10*a* of the present invention, during the course of the papermaking process. The characteristics of the embryonic web 60 and the various possible techniques for forming the embryonic web 60 are described in the commonly assigned U.S. Pat. No. 4,529,480 which is incorporated by reference herein. In the process shown in FIG. 6, the embryonic web 60 is formed from the cellulosic fibers suspended in a liquid carrier between breast roll 18*a* and return roll 18*b* by depositing the cellulosic fibers suspended in a liquid carrier onto the forming wire 10*a* and removing a portion of the liquid carrier through the belt 10*a*. Conventional vacuum boxes, forming boards, hydrofoils, and the like which are not shown in FIG. 6 are useful in effecting the removal of liquid carrier.

Figure 4:
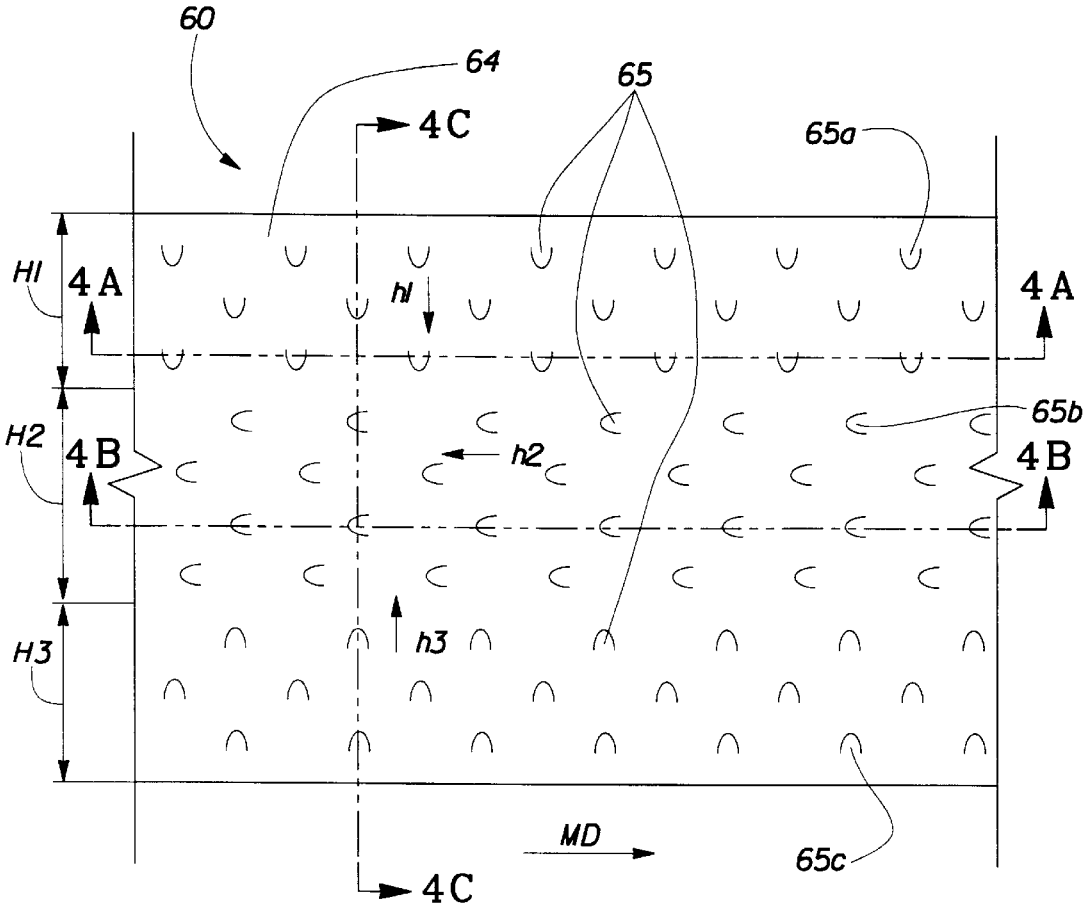
FIG. 4 is a schematic top plan view of a paper web produced on the papermaking belt of the present invention shown in FIGS. 1–1C, the paper web having three zones of knuckles, the knuckles of each zone having a specific orientation different from the orientations of the knuckles of the other two zones.
Figure 4A:
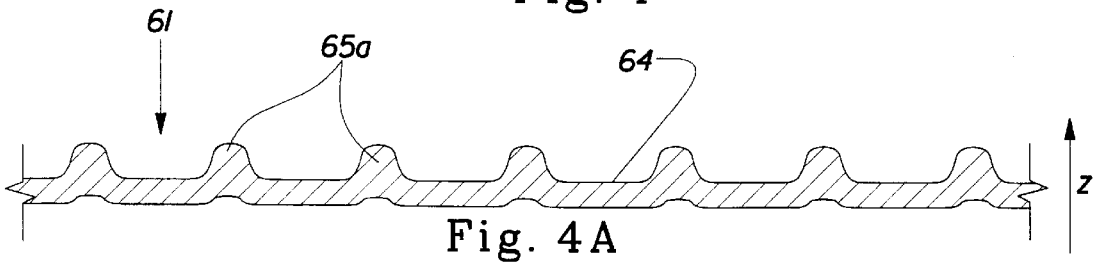
FIG. 4A is a schematic fragmentary cross-sectional view of the paper web taken along lines 4A—4A of FIG. 4.
Figure 4B:
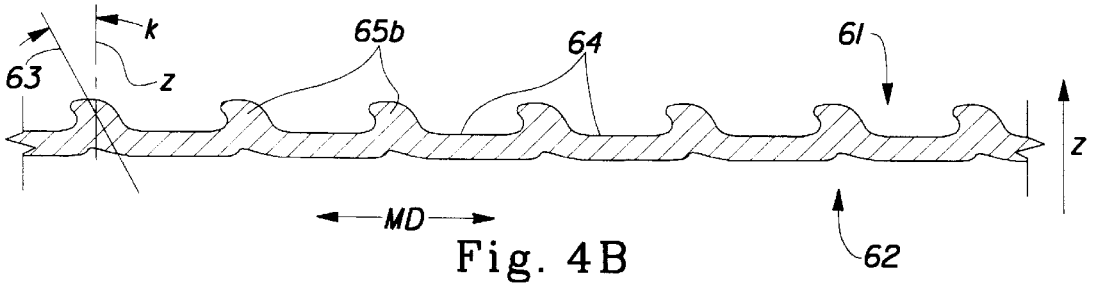
FIG. 4B is a schematic fragmentary cross-sectional view of the paper web taken along lines 4B—4B of FIG. 4.
Figure 4C:
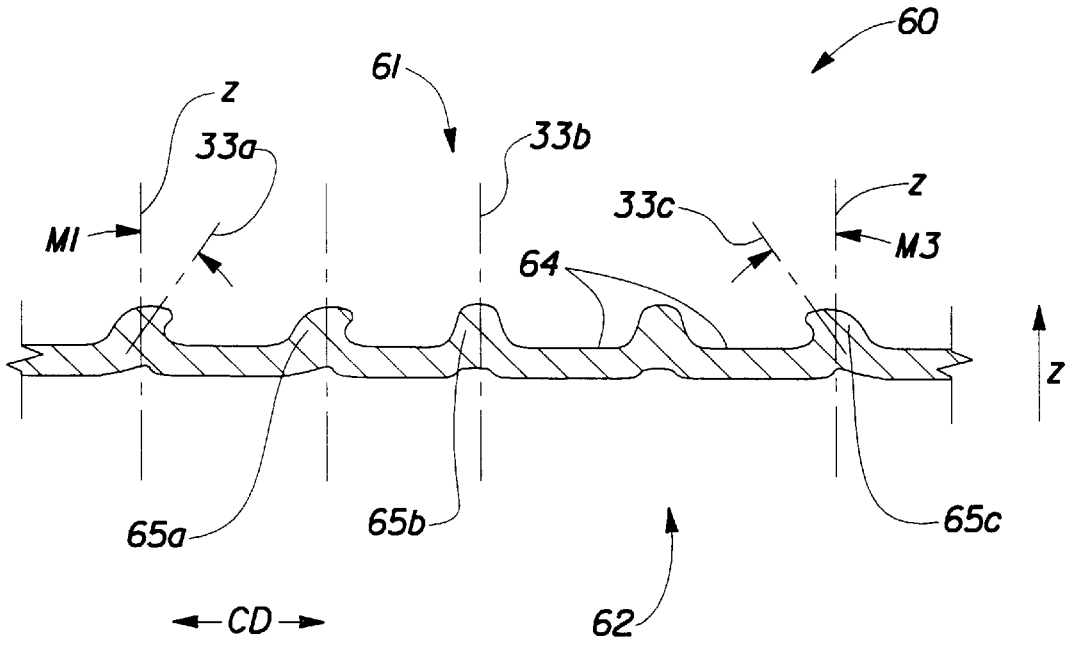
FIG. 4C is a schematic fragmentary cross-sectional view of the paper web taken along lines 4C—4C of FIG. 4.
Figure 4D:
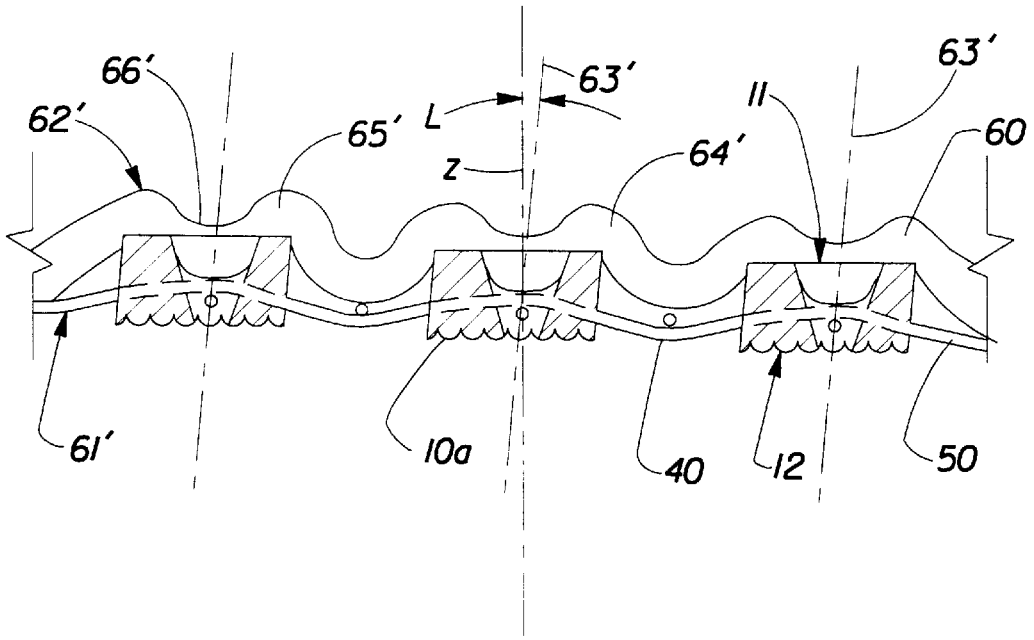
FIG. 4D is a schematic fragmentary cross-sectional view of a prophetic web produced on the papermaking belt of the present invention shown in FIGS. 3 and 3A.

The embryonic web 60 formed on the forming belt 10*a* of the present invention and shown in FIG. 4D has a first side 61* and a second side 62* opposite the first side 61*. The first side 61* is that side which is associated with the web-contacting surface 11 of the belt 10*a*. When the belt 10 of the present invention is utilized as the forming belt 10*a*, the embryonic web 60 shown in FIG. 4D comprises a macroscopically planar and patterned first region 64* (corresponding to the area of essentially continuous conduits 70) preferably having a relatively high basis weight, and a second region 65* (corresponding to the area of discrete protuberances 40) preferably having a relatively low basis weight. The first region 64* comprises an essentially continuous network; and the second region 65* comprises a plurality of discrete "angled" knuckles 65* extending from the first region 64* in at least one direction. This at least one direction (defined by an imaginary axis 63* of a knuckle of the second region 65) and the Z-direction form an acute angle L therebetween (corresponding to the acute angles S formed between the Z-direction and the axes 43 of the conduits 40). The second region 65* is circumscribed by and adjacent to the first region 64*. The second region 65* comprising the discrete angled knuckles having a low basis weight preferably occur in a non-random repeating pattern corresponding to the pattern of the plurality of discrete protuberances 40 of the forming belt 10*a*.

If the forming belt 10*a* has the essentially continuous conduits 70 and the discrete conduits 30, the embryonic web 60 may comprise a third region 66* preferably having an intermediate basis weight relative to the basis weight of the first region 64* and the basis weight of the second region 65*. The third region 66* occurs in a preferred non-random repeating pattern substantially corresponding to the low flow rate zones, i. e., the zones of the discrete conduits 30. The third region 66* is juxtaposed with, and preferably circumscribed by, the second region 65*.

After the embryonic web 60 is formed, the embryonic web 60 travels with the forming wire 10*a* in the direction indicated by the directional arrow A (FIG. 6) to be brought into the proximity of the through-air drying belt 10*b*. The preferred through-air belt 10*b* is described in great detail hereinabove. The through-air belt 10*b* is a macroscopically monoplanar papermaking belt comprising the resinous framework 20 having the web-side surface 21 defining the X-Y plane, the backside surface 22 opposite the web-side surface 21, the Z-direction perpendicular to the X-Y plane, and the plurality of discrete deflection conduits 30 extending between the web-side surface 21 and the backside surface 22. Each of the conduits 30 has the axis 33 and the walls 35. In accordance with the present invention, the axes 33 of at least some of the conduits 30 and the Z-direction form the acute angles Q therebetween.

The next steps are depositing the embryonic web 60 to the web-side surface 21 of the resinous framework 20 of the through-air drying belt 10*b* and applying a fluid pressure differential to the embryonic web 60 to deflect at least a portion of the papermaking fibers into the discrete deflection conduits 30 and to remove water from the embryonic web 60 into the discrete deflection conduits 30 thereby forming an intermediate web 60.

In the embodiment illustrated in FIG. 6, the through-air drying belt 10*b* of the present invention travels in the direction indicated by directional arrow B. The belt 10*b* passes around the return rolls 19*c*, 19*d*, impression nip roll 19*e*, return rolls 19*a*, and 19*b*. An emulsion distributing roll 19*f* distributes an emulsion onto the through-air drying belt 10*b* from an emulsion bath. The loop around which the through-air drying belt 10*b* of the present invention travels also includes a means for applying a fluid pressure differential to the web 60, which means in the preferred embodiment of the present invention comprises vacuum pick-up shoe 17*a* and a vacuum box 17*b*. The loop may also include a pre-dryer (not shown). In addition, water showers (not shown) may preferably be utilized in the papermaking process of the present invention to clean the through-air drying belt 10*b* of any paper fibers, adhesives, and the like, which may remain attached to the through-air drying belt 10*b* after it has traveled through the final step of the papermaking process. Associated with the through-air drying belt 10*b* of the present invention, and also not shown in FIG. 6, are various additional support rolls, return rolls, cleaning means, drive means, and the like commonly used in papermaking machines and all well known to those skilled in the art.

When the through-air drying belt 10*b* of the present invention is utilized in the papermaking process, the intermediate web 60 shown in FIGS. 4–4C comprises a macroscopically monoplanar, patterned, and essentially continuous network region 64 preferably having relatively high density and a domes region 65 preferably having relatively low density. The domes region 65 comprises a plurality of discrete domes 65, or 65*a*, 65*b*, 65*c*, protruding from, circumscribed by, and adjacent to the network region 63. Each of the domes 65 has an axis 63. The axes 63 of at least some of the domes 65 and the Z-direction form acute angles K (FIG. 4B) and acute angles M1 and M3 (FIG. 4C) therebetween.

The papermaking process of the present invention may also include an optional step of pre-drying the intermediate web 60 to form a pre-dried web 60. Any convenient means conventionally known in the papermaking art can be used to dry the intermediate web 60. For example, flow-through dryers, non-thermal, capillary dewatering devices, and Yankee dryers, alone and in combination, are satisfactory.

The next step in the papermaking process is impressing the web-side network 21* of the resinous framework 20 into the pre-dried web 60 by interposing the predried web 60 between the belt 10 and an impression surface to form an imprinted web 60 of papermaking fibers. If the intermediate web 60 is not subjected to the optional pre-drying step, this step is performed on the intermediate web 60.

The step of impressing is carried out in the machine illustrated in FIG. 6 when the pre-dried (or intermediate) web 60 passes through the nip formed between the impression nip roll 19*e* and the Yankee drier drum 14. As the predried web 60 passes through this nip, the network pattern formed on the web-side network 21* of the framework 20 is impressed into the pre-dried web 60 to form an imprinted web 60.

The next step in the papermaking process is drying the imprinted web 60. As the imprinted web 60 separates from the belt 10, it is adhered to the surface of Yankee dryer drum 14 where it is dried to a consistency of at least about 95% to form a dried web 60.

The next step in the papermaking process is an optional, and highly preferred, step of foreshortening the dried web 60. As used herein, foreshortening refers to the reduction in length of a dry paper web 60 which occurs when energy is applied to the dry web 60 in such a way that the length of the web 60 is reduced and the fibers in the web 60 are rearranged with an accompanying disruption of fiber-fiber bonds. Foreshortening can be accomplished in any of several well-known ways. The most common, and preferred, method is creping schematically shown in FIG. 6. In the creping operation, the dried web 60 is adhered to a surface and then removed from that surface with a doctor blade. As shown in FIG. 6, the surface to which the web 60 is usually adhered also functions as a drying surface, typically the surface of the Yankee dryer drum 14. Generally, only the non-deflected portions of the web 60 which have been associated with web-side network 21* on the web-contacting side 11 of the papermaking belt 10 are directly adhered to the surface of Yankee dryer drum 14. The pattern of the web-side network 21* and its orientation relative to the doctor blade will in major part dictate the extent and the character of the creping imparted to the web. If desired, the dried web 60 may not be creped.

The general physical characteristics of the paper web 60 which is made by the process of the present invention utilizing the through-air drying belt 10*a* having an essentially continuous framework 20 are described in the aforementioned U.S. Pat. No. 4,529,480 entitled "Tissue Paper", which issued to Trokhan on Jul. 16, 1985, and which is incorporated herein by reference.

The plurality of domes 65 in the paper web 60 of the present invention, however, will prophetically form an "angled" pattern, due to the "angled" position of the conduits 30 of the through-air drying belt 10 of the present invention. It should be understood that the steps of imprinting, drying, and—especially—creping may interfere with the "angled" position of the domes 65. That is to say, the processing of the web 60 after it is separated from the through-air drying belt 10*b* may affect the overall configuration of the domes 65 as well as the acute angles K (FIG. 4B) and M1, M3 (FIG. 4C) formed between the Z-direction and the axes of the domes 65 in such a way that these acute angles may not be equal to the corresponding angles Q between the Z-direction and the axes 33 of the conduits 30. It is believed, however, that the paper web 60 according to the present invention will have the cross-sectional "angled" pattern of the domes 65 generally following the cross-sectional angled pattern of the conduits 30 of the resinous framework 20.

FIGS. 4–4C show one prophetic embodiment of the paper web 60 according to the present invention. Preferably, the domes 65 are disposed in a non-random and repeating pattern which corresponds to the pattern of the discrete conduits 30 of the resinous framework 20 of the belt 10. While not being intended to be bound by theory, the Applicant believes that the paper 60 having the acutely angled domes 65 is softer than the comparable paper having domes generally perpendicular relative to the plane of the network region 64, because the acutely angled domes 65 are believed to be more easily collapsible than the generally perpendicularly upstanding domes. Moreover, it is believed that the angled domes 65 having a specific pre-determined directional orientation may provide a benefit of facilitating a distribution of liquids in a desired direction. This property may prove to be very beneficial if the paper 60 is used in such disposable products as diapers, sanitary napkins, wipes, and the like.

For example, the paper web 60 shown in FIGS. 4 and 4C has three zones of relative orientation: a first zone H1, the second zone H2, and a third zone H3. As best shown in FIGS. 4 and 4C, the first zone H1 has the domes 65*a* oriented in a first direction h1, the second zone H2 has the domes 65*b* oriented in a second direction h2, and the third zone H3 has the domes 65*c* oriented in a third direction h3. Viewed in plane, the first direction h1 and the second direction h2 are directed towards each other, and the third direction h3 is perpendicular to the first and second directions h1, h2.

What is claimed is:

1. A macroscopically monoplanar papermaking belt for use in a papermaking machine, said papermaking belt comprising:

an air-permeable reinforcing structure having a web-facing side defining an X-Y plane, a machine-facing side opposite said web-facing side, and a Z-direction perpendicular to said X-Y plane; and a resinous framework comprised of a plurality of discrete protuberances joined to and extending from said reinforcing structure, each of said protuberances having an axis, a top surface, a base surface opposite said top surface, and walls spacing apart and interconnecting said top surface and said base surface, the axes of at least some of said protuberances and said Z-direction forming acute angles therebetween, a plurality of said top surfaces defining a web-side surface of said resinous framework, and a plurality of said base surfaces defining a backside surface of said resinous framework.

2. The papermaking belt according to claim 1, wherein said protuberances are circumscribed by and adjacent to an area of essentially continuous deflection conduits.

3. The papermaking belt according to claim 2, wherein said web-facing side of said reinforcing structure has an essentially continuous web-facing network formed therein, said web-facing network being defined by said area of essentially continuous deflection conduits.

4. The papermaking belt according to claim 3, wherein said top surfaces of at least some of said protuberances are off-set relative to said corresponding base surfaces of said at least some of said protuberances within said X-Y plane in at least one direction perpendicular to said Z-direction.

5. The papermaking belt according to claim 4, wherein said walls of at least some of said protuberances are tapered relative said axes of said at least some of said protuberances.

6. The papermaking belt according to claim 5, wherein said plurality of protuberances comprises a non-random repeating patterned array in said X-Y plane.

7. The papermaking belt according to claim 6, wherein said plurality of protuberances has a plurality of discrete deflection conduits therein, said discrete deflection conduits extending from said web-side surface to said back surface of said resinous framework.

8. The papermaking belt according to claim 7, wherein each of said plurality of protuberances has at least one deflection conduit therein, said at least one deflection conduit extending from said top surface to said base surface of each of said plurality of discrete protuberances.

9. The papermaking belt according to claim 6, wherein said backside surface of said resinous framework is textured.

10. A process for producing a cellulosic fibrous web having at least two regions disposed in a non-random repeating pattern, the process comprising the steps of:

providing a plurality of cellulosic fibers suspended in a liquid carrier;

providing a macroscopically monoplanar papermaking belt comprising an air-permeable reinforcing structure having a web-facing side defining an X-Y plane, a machine-facing side opposite said web-facing side, and a Z-direction perpendicular to said X-Y plane, said papermaking belt further comprising a resinous framework comprised of a plurality of discrete protuberances joined to and extending from said reinforcing structure, each of said protuberances having an axis, a base surface, a top surface, and walls spacing apart and interconnecting said base surface and said top surface, said axes of at least some of said protuberances and said Z-direction forming acute angles therebetween, a plurality of said top surfaces defining a web-side surface of said resinous framework, and a plurality of base surfaces defining a backside surface of said resinous framework;

depositing said cellulosic fibers and said carrier onto the papermaking belt;

draining said carrier through said papermaking belt, thereby forming the fibrous web having a macroscopically planar and patterned first region disposed in said X-Y plane having an essentially continuous network, and a second region comprised of a plurality of discrete knuckles, said knuckles being circumscribed by, adjacent to and extending from said first region in at least one direction, said at least one direction and said Z-axis forming an acute angle therebetween.

11. A process for producing a cellulosic fibrous web having at least two regions distinguished by basis weight and disposed in a non-random repeating pattern, the process comprising the steps of:

providing a plurality of cellulosic fibers suspended in a liquid carrier;

providing a macroscopically monoplanar papermaking belt comprising an air-permeable reinforcing structure having a web-facing side defining an X-Y plane, a machine-facing side opposite said web-facing side, and a Z-direction perpendicular to said X-Y plane, said papermaking belt further comprising a resinous framework comprised of a plurality of discrete protuberances joined to and extending from said reinforcing structure, each of said protuberances having an axis, a base surface, a top surface, and walls spacing apart and interconnecting said base surface and said top surface, said axes of at least some of said protuberances and said Z-direction forming acute angles therebetween, a plurality of said top surfaces defining a web-side surface of said resinous framework, and a plurality of base surfaces defining a backside surface of said resinous framework;

depositing said cellulosic fibers and said carrier onto the papermaking belt;

draining said carrier through said papermaking belt, thereby forming the fibrous web comprising a macroscopically planar and patterned first region disposed in said X-Y plane having an essentially continuous network having a relatively high basis weight, and a second region comprised of a plurality of discrete knuckles having a relatively low basis weight, said knuckles being circumscribed by, adjacent to and extending from said first region in at least one direction, said at least one direction and said Z-axis forming an acute angle therebetween.

* * * * *